US009864329B2

(12) United States Patent
Taguchi et al.

(10) Patent No.: US 9,864,329 B2
(45) Date of Patent: Jan. 9, 2018

(54) DEVELOPER CARTRIDGE PROVIDED WITH GEAR INCLUDING PROTRUSION

(71) Applicant: BROTHER KOGYO KABUSHIKI KAISHA, Nagoya-shi, Aichi-ken (JP)

(72) Inventors: Kazuna Taguchi, Nagoya (JP); Yasuo Fukamachi, Nagoya (JP); Motoaki Mushika, Hashima (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/392,034

(22) Filed: Dec. 28, 2016

(65) Prior Publication Data

US 2017/0108821 A1 Apr. 20, 2017

Related U.S. Application Data

(63) Continuation of application No. PCT/JP2015/004940, filed on Sep. 29, 2015.

(51) Int. Cl.
*G03G 21/16* (2006.01)
*G03G 15/00* (2006.01)
(Continued)

(52) U.S. Cl.
CPC ..... *G03G 21/1647* (2013.01); *G03G 15/0865* (2013.01); *G03G 15/55* (2013.01);
(Continued)

(58) Field of Classification Search
CPC ..... G03G 15/55; G03G 21/1647; G03G 21/1676; G03G 21/1857; G03G 21/1875;
(Continued)

(56) References Cited

U.S. PATENT DOCUMENTS

2011/0236065 A1 9/2011 Takagi
2011/0243578 A1 10/2011 Ukai et al.
(Continued)

FOREIGN PATENT DOCUMENTS

EP 2 369 423 A 9/2011
EP 2 506 087 A 10/2012
(Continued)

OTHER PUBLICATIONS

Extended European Search Report issued in related European Patent Application No. 15 89 5856.1, dated Jun. 17, 2017.
(Continued)

*Primary Examiner* — Carla Therrien
(74) *Attorney, Agent, or Firm* — Merchant & Gould P.C.

(57) ABSTRACT

A developer cartridge comprises a first gear. The first gear may include a first protrusion extending in a radial direction of the first gear. The first protrusion may be positioned at a circumference of a column of the first gear. The first protrusion may be spaced apart from a second end face opposite to a first end face facing an exterior surface of a casing configured to accommodate developer therein. The first protrusion may be further from the second end face than a large-diameter gear in an axial direction. A rotational circumference of the first protrusion defined by rotation of the first protrusion and a portion of the large-diameter gear are aligned in the axial direction.

32 Claims, 22 Drawing Sheets

(51) Int. Cl.
*G03G 21/18* (2006.01)
*G03G 15/08* (2006.01)

(52) U.S. Cl.
CPC ..... *G03G 21/1676* (2013.01); *G03G 21/1857* (2013.01); *G03G 21/1896* (2013.01); *G03G 2215/0695* (2013.01); *G03G 2221/1657* (2013.01)

(58) Field of Classification Search
CPC ..... G03G 21/1896; G03G 2221/1657; G03G 2221/1892; G03G 2215/0695
See application file for complete search history.

(56) References Cited

U.S. PATENT DOCUMENTS

2012/0251216 A1* 10/2012 Mushika ..... G03G 21/1896 400/352
2013/0142523 A1 6/2013 Yamaoka
2014/0086613 A1 3/2014 Itabashi et al.
2015/0003868 A1* 1/2015 Shimizu ..... G03G 15/0896 399/119
2015/0117873 A1* 4/2015 Mori ..... G03G 21/1857 399/12
2015/0277282 A1* 10/2015 Taguchi ..... G03G 15/0865 399/12
2015/0277353 A1* 10/2015 Fukamachi ..... G03G 15/0865 399/12
2015/0277355 A1* 10/2015 Taguchi ..... G03G 21/1647 399/12
2015/0277356 A1* 10/2015 Mushika ..... G03G 15/0865 399/12
2017/0108820 A1 4/2017 Taguchi et al.

FOREIGN PATENT DOCUMENTS

EP 2 871 532 A 5/2015
JP 2000-221781 A 8/2000
JP 2011-215374 A 10/2011
JP 2013-050495 A 3/2013

OTHER PUBLICATIONS

International Search Report and Written Opinion issued in related international patent application PCT/JP2015/004939, dated Dec. 28, 2015.
U.S. Appl. No. 15/391,954, filed Dec. 28, 2016.
Office Action (Notice of Allowance) issued in related U.S. Appl. No. 15/391,954, Aug. 29, 2017.
Extended European Search Report issued in related European Patent Application No. 15 89 5856.1, Jun. 29, 2017.
Extended European Search Report issued in corresponding EP Application No. 15895857.9, dated Sep. 26, 2017.

* cited by examiner

DEVELOPER CARTRIDGE PROVIDED WITH GEAR INCLUDING PROTRUSION

CROSS REFERENCE TO RELATED APPLICATION

This application is a continuation of International Application No. PCT/JP2015/004940 filed Sep. 29, 2015 in Japan Patent Office as a Receiving Office. The entire content of the above noted application is incorporated herein by reference.

TECHNICAL FIELD

The present disclosure relates to a developer cartridge.

BACKGROUND

A known developer cartridge is configured to be attached to and detached from an image forming apparatus (e.g., a laser printer) and store toner (e.g., developer) therein. Among various types of image forming apparatuses, an image forming apparatus is configured to determine whether an amount of toner remaining in a developer cartridge is relatively low. Another image forming apparatus is configured to determine whether the number of pages that have been printed in the image forming apparatus is greater than a predetermined number. When a positive determination is made in such a determination in each of the apparatuses, each apparatus controls its display to display thereon information prompting a user to replace a currently-attached developer cartridge with another developing cartridge. In accordance with the information displayed on the display, the user removes the currently-attached developer cartridge and replace with another developer cartridge.

SUMMARY

In response to the replacement of the currently-attached developer cartridge with another developer cartridge, such apparatuses may also be configured to determine, based on rotation of a specific gear which the newly-attached developer cartridge includes, whether the newly-attached developer cartridge is a new (or not-yet-used) developer cartridge. These apparatuses may be further configured to identify a specification (e.g., an amount of remaining toner or the maximum printable number of pages) of the newly-attached developer cartridge by detecting a shape of specific gear of the developer cartridge. The specific gear may include one or more of protrusions for identifying a specification. Conventionally, the developer cartridge includes one or more of gears for rotating the specific gear. If the developer cartridge includes a small-diameter gear engaging with the specific gear and a large-diameter gear rotatable with the small-diameter gear, the large-diameter gear may prevent the specific gear from rotating smoothly, because the large-diameter gear contacts the specific gear.

Therefore, a need has arisen for a developer cartridge which overcomes these and other shortcomings of the related art. The present disclosure provides for a gear having a new structure for identifying a specification of a developer cartridge and the new structure allows the gear to rotate smoothly.

According to an aspect of the present disclosure a developer cartridge comprises a casing configured to accommodate developer therein. The developer cartridge comprises a small-diameter gear. The small-diameter gear is positioned at an exterior surface of the casing. The small-diameter gear is rotatable about a first axis extending in an axial direction. The small-diameter gear includes a first engagement portion along at least a portion of a circumference of the small-diameter gear. The developer cartridge comprises a large-diameter gear. The large-diameter gear is positioned at the exterior surface of the casing. The large-diameter gear is rotatable about the first axis. The large-diameter gear is positioned farther from the exterior surface than the small-diameter gear in the axis direction. The developer cartridge comprises a first gear. The first gear is positioned at the exterior surface of the casing. The first gear is rotatable about a second axis extending in the axial direction. The second axis is different from the first axis. The first gear includes a second engagement portion along at least a portion of a circumference of the first gear. At least a portion of the second engagement portion engages with at least a portion of the first engagement portion. The first gear includes a first end face facing the exterior surface in the axial direction. The first gear includes a second end face opposite to the first end face in the axial direction. The second end face is spaced apart from the large-diameter gear in the axial direction. The second end face is positioned closer to the exterior surface than the large-diameter gear. A portion of the second end face and a portion of the large-diameter gear are aligned along the axial direction. The first gear includes a column. The column is positioned at the second end face, the column extending in the axial direction. An outer diameter of the column is smaller than an outer diameter of the first gear. The column is positioned outside of a rotational circumference defined by rotation of the large-diameter gear. The first gear includes a first protrusion. The first protrusion extends in a radial direction of the first gear. The first protrusion is positioned at a circumference of the column. The first protrusion is spaced apart from the second end face in the axial direction. The first protrusion is farther from the second end face than the large-diameter gear in the axial direction. A rotational circumference of the first protrusion defined by rotation of the first protrusion and a portion of the large-diameter gear are aligned in the axial direction.

Other objects, features, and advantages will be apparent to persons of ordinary skill in the art from the following detailed description of the disclosure and the accompanying drawings.

BRIEF DESCRIPTION OF THE DRAWINGS

For a more complete understanding of the present disclosure, needs satisfied thereby, and the objects, features, and advantages thereof, reference now is made to the following description taken in connection with the accompanying drawings.

DETAILED DESCRIPTION

Figure 1:
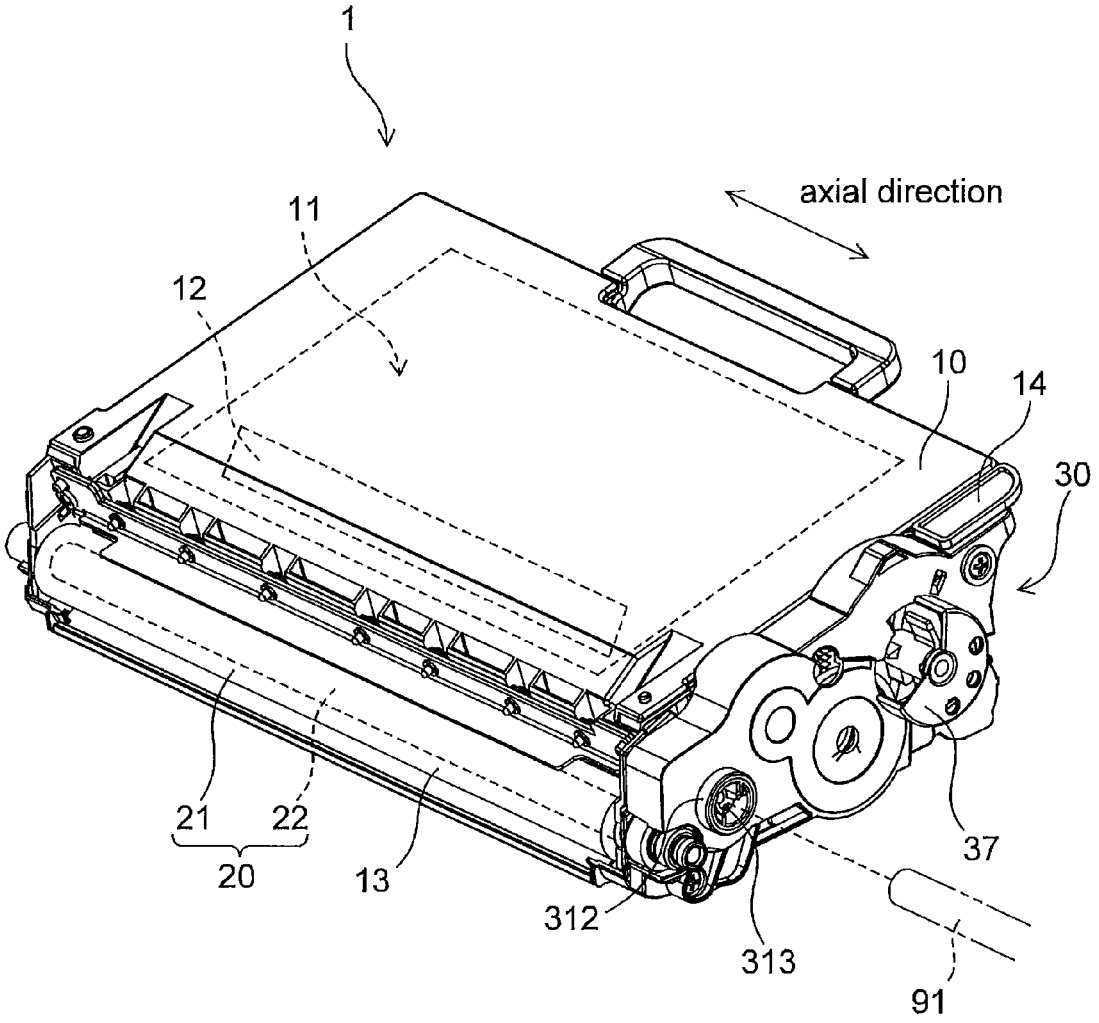
FIG. 1 is a perspective view of a developer cartridge according to an embodiment of the present disclosure.

Hereinafter, a preferred embodiment of the present disclosure will be described in detail with reference to the accompanying drawings, like reference numerals being used for like corresponding parts in the various drawings.

In this embodiment, a detection gear (e.g., a first gear) is rotatable about a first axis. Hereinafter, a direction that the first axis extends is referred to as an axial direction. The axial direction is indicated by a double-headed arrow.

<1. Overall Configuration of Developer Cartridge>

FIG. 1 is a perspective view of a developer cartridge 1. As depicted in FIG. 1, the developer cartridge 1 is configured to be attached to and detached from an electrophotographic image forming apparatus (e.g., a laser printer or a light-emitting diode printer). The developer cartridge 1 is further configured to supply developer (e.g., toner) to an outer surface of a photosensitive drum. As depicted in FIG. 1, the developer cartridge 1 includes a casing 10, a developing roller 20, and a gear unit 30.

The casing 10 is configured to store therein toner for electrophotographic printing. The casing 10 includes a first exterior surface and a second exterior surface. The gear unit 30 is disposed at the first exterior surface. The second exterior surface is spaced from and opposite to the first exterior surface in the axial direction. The casing 10 has a rectangular parallelepiped shape extending in the axial direction. A toner chamber 11 for storing toner is defined inside the casing 10. The casing 10 includes an agitator 12 inside the toner chamber 11. The agitator 12 extends in the axial direction. The agitator 12 is mounted to an agitator gear 34 and is rotatable with the agitator gear 34. As the agitator 12 rotates, the agitator 12 agitates toner stored in the toner chamber 11. This agitation of toner by the agitator 12 reduces or prevents aggregation of toner particles in the toner chamber 11.

The developing roller 20 has a cylindrical shape. The developing roller 20 is rotatable about a fifth axis A5 extending in the axial direction. The developing roller 20 includes a roller body 21 and a roller shaft 22. The roller body 21 has a cylindrical shape extending in the axial direction. The roller body 21 is made of, for example, rubber, having elasticity. The roller shaft 22 has a circular shape extending in the axial direction. The roller shaft 22 penetrates through the roller body 21 in the axial direction. The roller shaft 22 is made of, for example, conductive metal or conductive resin. The roller body 21 is fixed to the roller shaft 22 so as not to rotate relative to the roller shaft 22. Therefore, as the roller shaft 22 rotates, the roller body 21 rotates with the roller shaft 22.

Nevertheless, the roller shaft 22 might not necessarily penetrate through the roller body 21 in the axial direction. In one example, two roller shafts 22 may be provided and extend from respective ends of the roller body 21 in the axial direction.

The casing 10 has an opening 13 that provides communication between the toner chamber 11 and the outside of the developer cartridge 1. The developing roller 20 is disposed at the opening 13, extending along the axial direction. More specifically, the roller body 21 of the developing roller 20 is disposed at the opening 13, extending along the axial direction. One end portion of the roller shaft 22 in the axial direction is mounted to a developing gear 32. The roller shaft 22 is fixed to the developing gear 32 so as not to rotate relative to the developing gear 32. Therefore, as the developing gear 32 rotates, the roller shaft 22 rotates, whereby the developing roller 20 rotates with the roller shaft 22.

When the image forming apparatus is in an image forming operation, a supply roller (not depicted) supplies toner onto an outer circumferential surface of the roller body 21 of the developing roller 20 from the toner chamber 11. At the time of supplying toner onto the outer circumferential surface of the roller body 21 of the developing roller 20, toner is positively charged between the developing roller 20 and the supply roller while bias voltage is applied to the roller shaft 22. Therefore, the positively-charged toner is transferred to the outer circumferential surface of the roller body 21 by electrostatic attraction between the roller shaft 22 and the charged toner.

The developer cartridge 1 further includes a layer-thickness regulating blade (not depicted). The layer-thickness regulating blade regulates a thickness of a toner layer formed on the outer circumferential surface of the roller body 21 of the developing roller 20 by scraping excess toner off the outer circumferential surface of the roller body 21. Thus, the toner layer having a uniform thickness is held on the outer circumferential surface of the roller body 21 of the developing roller 20. Thereafter, the toner held on the outer circumferential surface of the roller body 21 of the developing roller 20 is supplied onto a surface of a photosensitive drum of the image forming apparatus. When toner is supplied to the surface the photosensitive drum from the outer circumferential surface of the roller body 21, toner is transferred onto an electrostatic latent image formed on the surface of the photosensitive drum. Thus, the electrostatic latent image is visualized on the surface of the photosensitive drum by toner.

The gear unit 30 is disposed at the first exterior surface of the casing 10. The gear unit 30 includes a plurality of gears and a gear cover 37. The gear cover 37 covers at least a portion of the plurality of gears. In one example, the gear cover 37 may cover at least one of the plurality of gears. In another example, the gear cover 37 may cover a portion of at least one of the plurality of gears. The plurality of gears of the gear unit 30 includes a coupling portion 312. In response to attachment of the developer cartridge 1 to the image forming apparatus, a driving shaft 91 of the image forming apparatus engages with the coupling portion 312 and applies a driving force to the coupling portion 312. The driving force applied from the driving shaft 91 is transmitted to the agitator 12 and the developing roller 20 via the plurality of gears of the gear unit 30.

<2. Configuration of Gear Unit>

Figure 2:
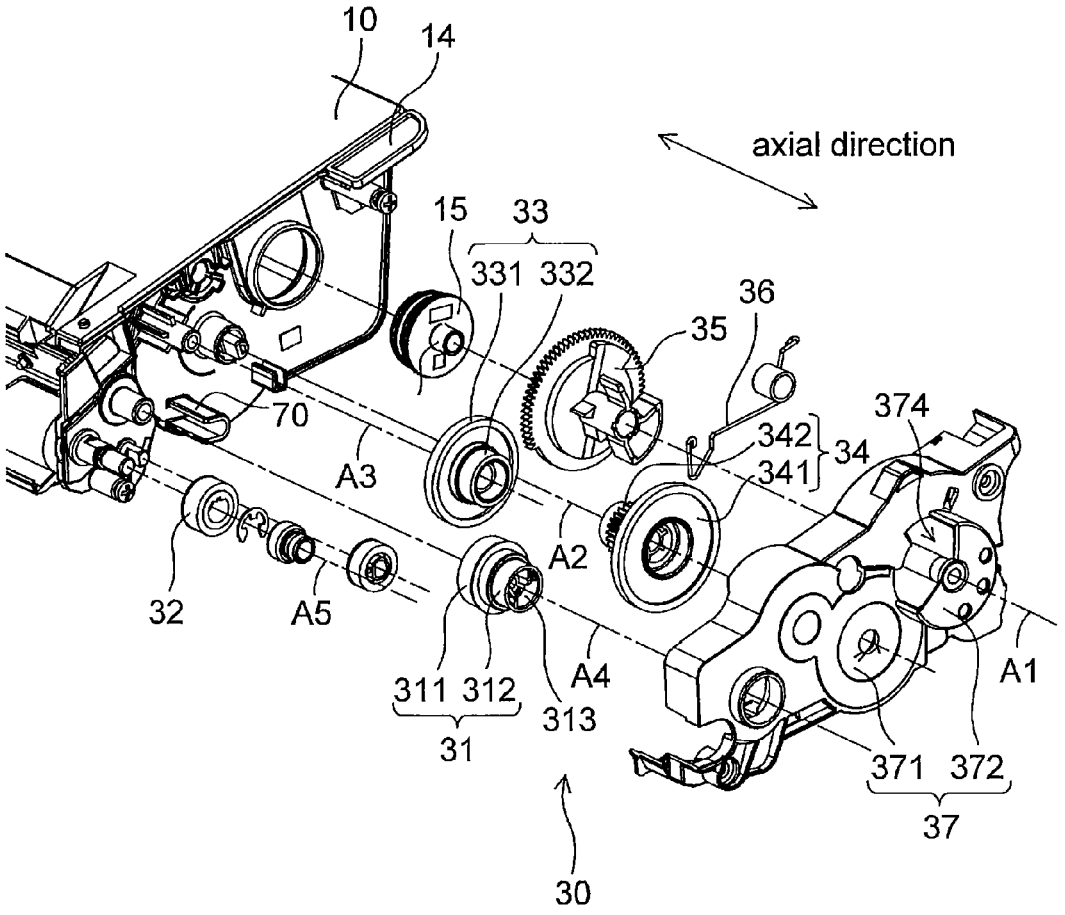
FIG. 2 is an exploded perspective view of a gear unit.
Figure 3:
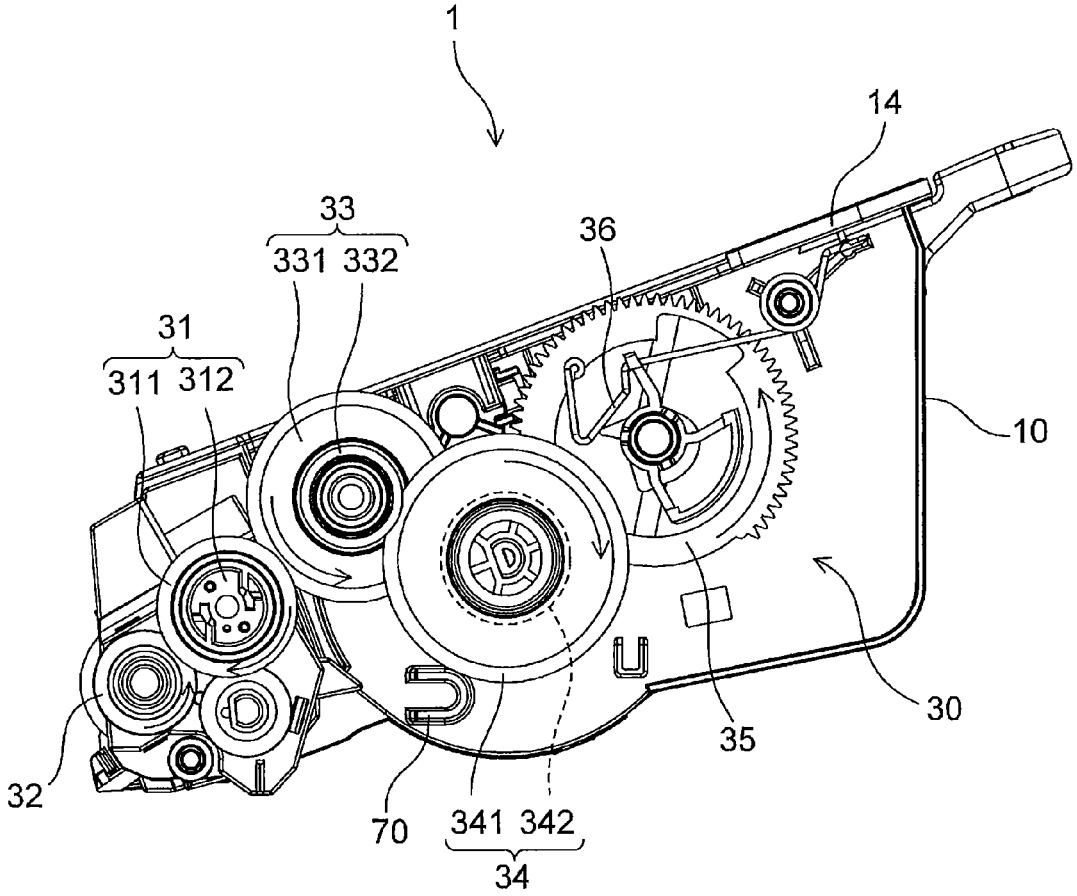
FIG. 3 illustrates the gear unit, in which a gear cover is removed.

Referring to FIGS. 1, 2, and 3, a configuration of the gear unit 30 will be described in detail.

FIG. 2 is an exploded view of the gear unit 30. FIG. 3 illustrates the gear unit 30 when viewed in the axial direction, in which the gear cover 37 is removed. As depicted in FIGS. 1, 2, and 3, the gear unit 30 includes a coupling 31, the developing gear 32, an idle gear 33, the agitator gear 34, a detection gear 35, a torsion spring 36, and the gear cover 37. The coupling 31, the developing gear 32, the idle gear 33, the agitator gear 34, and the detection gear 35 are rotatable about respective axes extending in the axial direction.

As depicted in FIGS. 2 and 3, a small-diameter gear 342 (e.g., a second gear) of the agitator gear 34 and the detection gear 35 have teeth. The gear teeth of the small-diameter gear 342 is one example of a first engagement portion. Although not depicted in FIGS. 2 and 3, the gears of the gear unit 30 other than the small-diameter gear 342 of the agitator gear 34 and the detection gear 35 also have teeth.

The coupling 31 is a gear that is configured to directly receive a driving force applied from the image forming apparatus. The coupling 31 is rotatable about a fourth axis A4 extending in the axial direction. The coupling 31 includes a coupling gear 311 and the coupling portion 312. The coupling gear 311 and the coupling portion 312 are made of, for example, resin and consist of one piece. The coupling gear 311 has teeth on its entire circumference at equal pitches. The coupling portion 312 includes a first end face and a second end face that is opposite to the first end face in the axial direction. The coupling portion 312 has a coupling hole 313 that is recessed relative to the second end face toward the first end face in the axial direction.

In response to attachment of the developer cartridge 1 to the image forming apparatus, the drive shaft 91 (indicated by a double-dotted-and-dashed line in FIG. 1) of the image forming apparatus is inserted into the coupling hole 313 of the coupling portion 312 in the axial direction. Thus, the drive shaft 91 and the coupling portion 312 are coupled to each other so as not to rotate relative to each other. Therefore, as the drive shaft 91 rotates, the coupling portion 312 rotates, whereby the coupling gear 311 rotates with the coupling portion 312.

The developing gear 32 is for rotating the developing roller 20. The developing gear 32 is rotatable about the fifth axis A5 extending in the axial direction. The developing gear 32 has teeth on its entire circumference at equal pitches. The coupling gear 311 and the developing gear 32 are in engagement with each other. For example, the coupling gear 311 and the developing gear 32 are in mesh with each other through their interlocking teeth. The developing gear 32 is mounted to one end portion of the roller shaft 22 of the developing roller 20 in the axial direction so as not to rotate relative to the roller shaft 22 of the developing roller 20. Therefore, as the coupling gear 311 rotates, the developing gear 32 rotates, whereby the developing roller 20 rotates with the developing gear 32.

The idle gear 33 is for transmitting rotary motion of the coupling gear 311 to the agitator gear 34. The idle gear 33 is rotatable about a third axis A3 extending in the axial direction. The idle gear 33 includes an input gear 331 and an output gear 332 that are aligned along the third axis A3. The input gear 331 and the output gear 332 are made of, for example, resin and consist of one piece. A distance in the axial direction between the first exterior surface of the casing 10 and the output gear 332 is greater than a distance in the axial direction between the first exterior surface of the casing 10 and the input gear 331. More specifically, a distance in the axial direction between the first exterior surface of the casing 10 and an edge of the output gear 332 that faces the first exterior surface of the casing 10 is greater than a distance in the axial direction between the first exterior surface of the casing 10 and an edge of the input gear 331 that faces the first exterior surface of the casing 10. The output gear 332 has an addendum circle diameter that is less than an addendum circle diameter of the input gear 331.

The input gear 331 has teeth on its entire circumference at equal pitches. The output gear 332 has teeth on its entire circumference at equal pitches. The coupling gear 311 and the input gear 331 are in engagement with each other. For example, the coupling gear 311 and the input gear 331 are in mesh with each other through their interlocking teeth. The output gear 332 and a large-diameter gear 341 of the agitator gear 34 are in engagement with each other. For example, the output gear 332 and the large-diameter gear 341 of the agitator gear 34 are in mesh with each other through their interlocking teeth. As the coupling gear 311 rotates, the input gear 331 rotates, whereby the output gear 332 rotates with the input gear 331. The rotation of the output gear 332 causes rotation of the agitator gear 34.

The agitator gear 34 is for rotating the agitator 12 disposed inside the toner chamber 11. The agitator gear 34 is rotatable about a second axis A2 extending in the axial direction. The agitator gear 34 includes the large-diameter gear 341 and the small-diameter gear 342 that are aligned along the second axis A2. The large-diameter gear 341 and the small-diameter gear 342 are made of, for example, resin and consist of one piece. The small-diameter gear 342 has an addendum circle diameter that is less than an addendum circle diameter of the large-diameter gear 341. A distance in the axial direction between the first exterior surface of the casing 10 and the small-diameter gear 342 is less than a distance in the axial direction between the first exterior surface of the casing 10 and the large-diameter gear 341. More specifically, a distance in the axial direction between the first exterior surface of the casing 10 and an edge of the small-diameter gear 342 that faces the first exterior surface of the casing 10 is less than a distance in the axial direction between the first exterior surface of the casing 10 and an edge of the large-diameter gear 341 that faces the first exterior surface of the casing 10.

The large-diameter gear 341 has teeth on its entire circumference at equal pitches. The small-diameter gear 342 has teeth on its entire circumference at equal pitches. As described above, the output gear 332 of the idle gear 33 and the large-diameter gear 341 of the agitator gear 34 are in mesh with each other through their interlocking teeth. The agitator gear 34 is mounted to one end portion of the agitator 12 in the axial direction so as not to rotate relative to the agitator 12. With this configuration, as a driving force is transmitted to the agitator gear 34 from the coupling 31 via the idle gear 33, the large-diameter gear 341 rotates, whereby the small-diameter gear 342 rotates with the large-diameter gear 341. The rotation of the agitator gear 34 causes rotation of the agitator 12.

The detection gear 35 is for providing the image forming apparatus with required information, e.g., specifications of the developer cartridge 1. The detection gear 35 is rotatable in a rotational direction about a first axis A1 extending in the axial direction. The detection gear 35 has teeth on a portion of its circumference. When the developer cartridge 1 is a new developer cartridge that has not been used yet, the detection gear 35 is configured to rotate in the rotational direction through meshing with the small-diameter gear 342 of the agitator gear 34. In response to attachment of the developer cartridge 1 to the image forming apparatus, the detection gear 35 starts to rotate. After the detection gear 35 rotate a predetermined degrees, the small-diameter gear 342 and the detection gear 35 disengage from each other. Finally, the detection gear 35 stops rotating.

<3. Configuration of Detection Gear>

Figure 4:
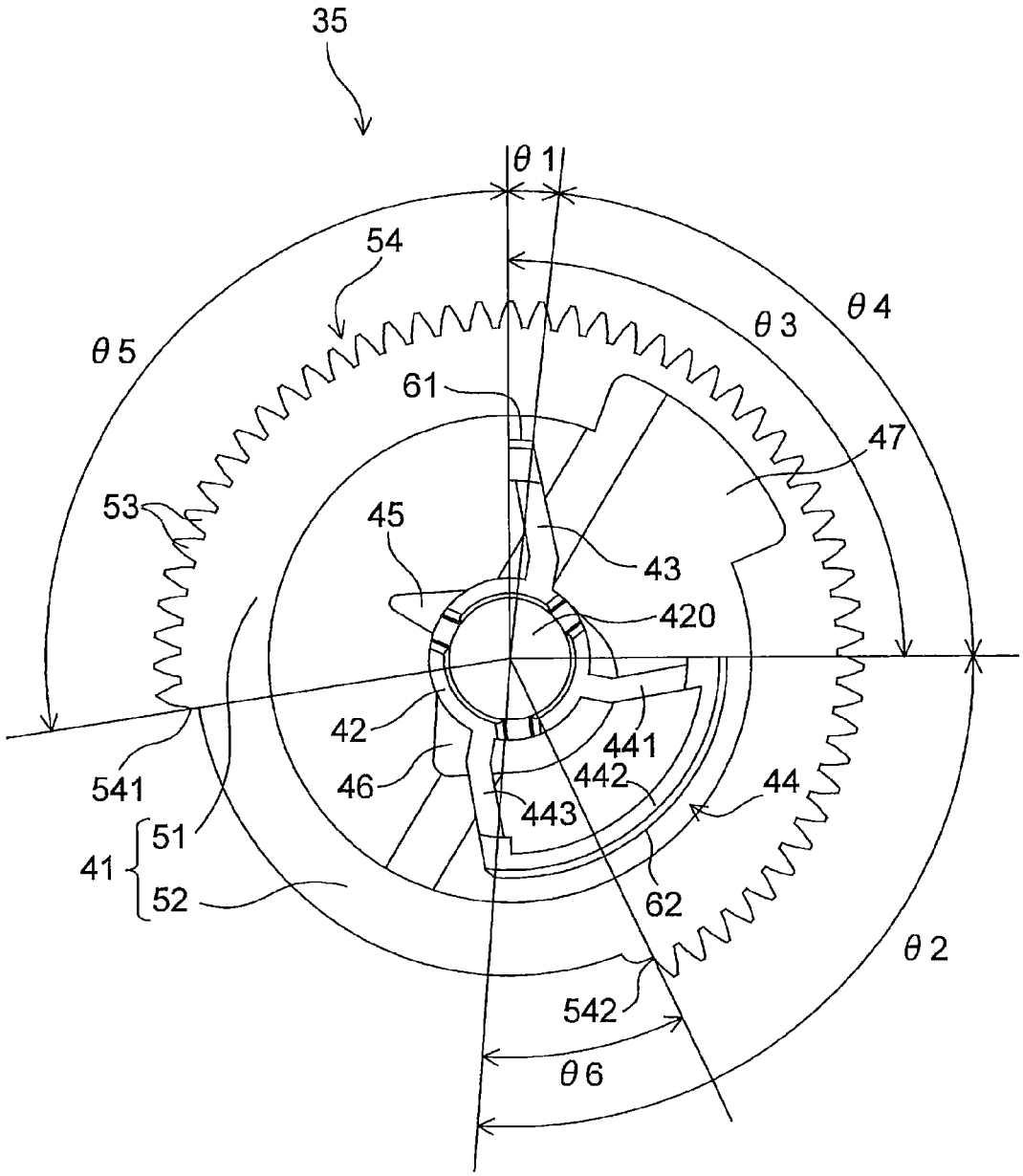
FIG. 4 illustrates a detection gear.
Figure 5:
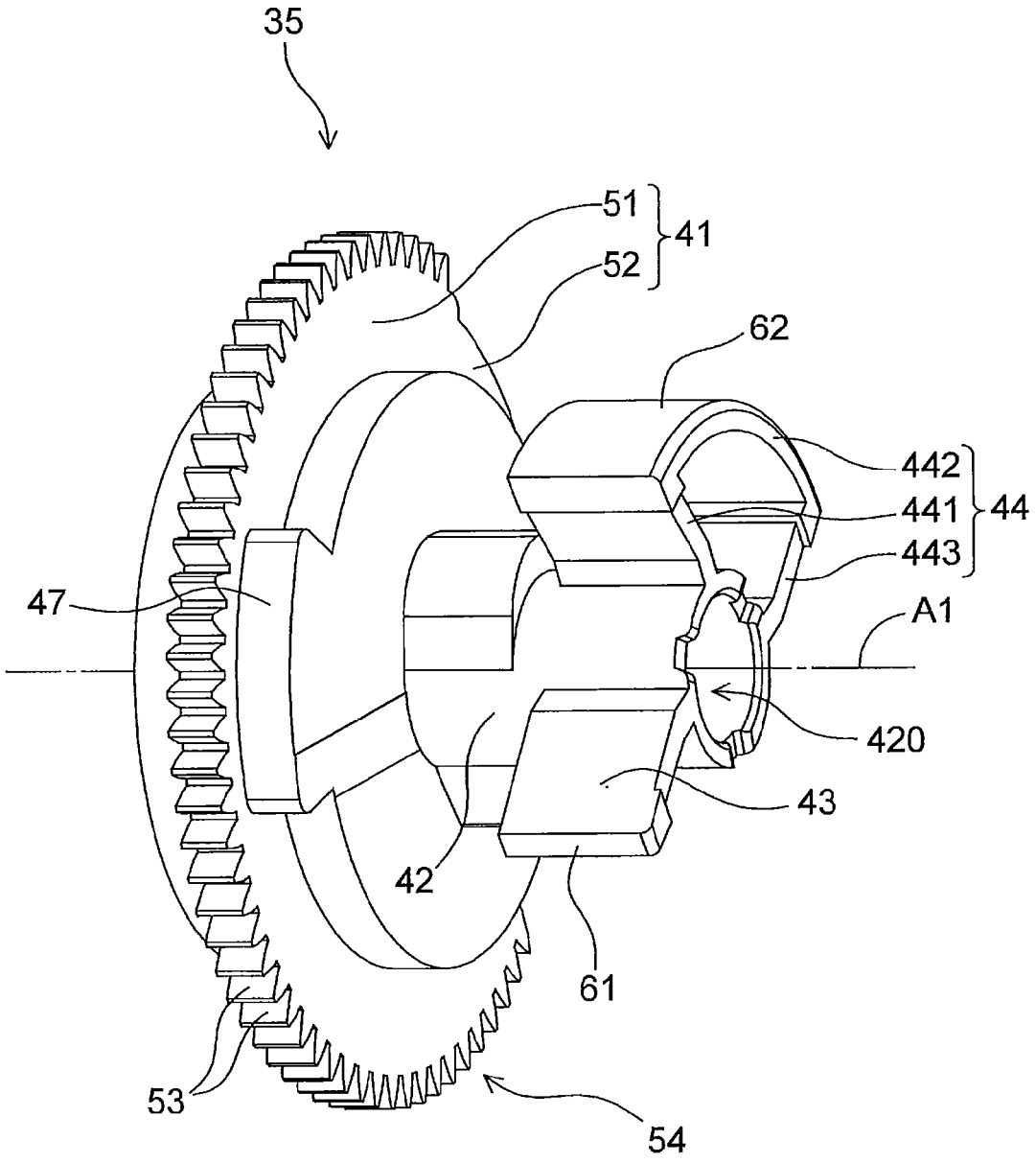
FIG. 5 is a perspective view of the detection gear.

Referring to FIGS. 4 and 5, the detection gear 35 will be described in detail.

FIG. 4 illustrates the detection gear 35 when viewed in the axial direction. FIG. 5 is a perspective view of the detection gear 35. As depicted in FIGS. 4 and 5, the detection gear 35 includes a circular plate 41, a cylindrical portion 42 (e.g., a column extending in the axial direction), a first protrusion 43, and a second protrusion 44. The circular plate 41, the cylindrical portion 42, the first protrusion 43, and the second protrusion 44 are made of, for example, resin and consist of one piece. Nevertheless, in other embodiments, for example, the detection gear 35 may consist of a plurality of separate components integral with each other. The detection gear 35 may be made of material other than resin.

The circular plate 41 extends in a direction orthogonal to the first axis A1. The circular plate 41 has a first end face and a second end face. The first end face faces the first exterior surface of the casing 10 in the axial direction. The second end face faces an inner surface of the gear cover 37 in the axial direction. In other words, the second end face is opposite to the first end face in the axial direction. The circular plate 41 has a plurality of teeth 53 on a portion of its circumference. For example, the circular plate 41 includes a first area 51 and a second area 52 that share their boundaries with each other in a circumferential direction of the circular plate 41. While the circular plate 41 has the teeth 53 on an outer edge of the first area 51, the circular plate 41 has no tooth on an outer edge of the second area 52. The teeth 53 are arranged along the circumferential direction of the circular plate 41 at equal pitches. The plurality of teeth 53 includes a second engagement portion 54 that is capable of engaging with the small-diameter gear 342 of the agitator gear 34.

One or more of the teeth of the small-diameter gear 342 of the agitator gear 34 are disposed within a rotational circumference defined by rotation of the second engagement portion 54 (e.g., the first area 51) of the circular plate 41. Therefore, the teeth of the small-diameter gear 342 and the teeth 53 of the circular plate 41 are capable of engaging with each other. The circular plate 41 has no tooth on the outer edge of the second area 52. The second area 52 is recessed toward the center of the detection gear 35 (e.g., the first axis A1) relative to the first area 51. The small-diameter gear 342 of the agitator gear 34 is disposed outside of a rotational circumference defined by rotation of the second area 52 of the circular plate 41.

The second engagement portion 54 includes a fifth end 541 and a sixth end 542. The fifth end 541 and the sixth end 542 are separate from each other in the circumferential direction of the circular plate 41. In this embodiment, the fifth end 541 refers to a leading end of the second engagement portion 54 in the rotational direction, and the sixth end 542 refers to a trailing end of the second engagement portion 54 in the rotational direction. In a new (or not-yet-used) developer cartridge 1, the second engagement portion 54 of the circular plate 41 is in engagement with of the small-diameter gear 342 of the agitator gear 34. For example, the fifth end 541 of the second engagement portion 54 of the circular plate 41 is in contact with at least one of the teeth of the small-diameter gear 342 of the agitator gear 34.

The cylindrical portion 42 protrudes toward the gear cover 37 from the second end face of the circular plate 41. The cylindrical portion 42 may be a column shape extending in the axial direction. The cylindrical portion 42 may be attached to the second end face of the circular plate 41. The cylindrical portion 42 extends in the axial direction along the first axis A1. The cylindrical portion 42 has a through hole 420 that penetrates a middle portion of the cylindrical portion 42. The through hole 420 is in engagement with a first support shaft 373 of the gear cover 37 while the first support shaft 373 passes through the through hole 420. As depicted in FIG. 2, a cap 15 is fixedly attached to the first exterior surface of the casing 10. For example, the first exterior surface of the casing 10 has a through-hole penetrating through the first exterior surface of the casing 10, and the cap 15 covers the through-hole. The cap 15 includes a second support shaft 151 that protrudes toward the detection gear 35. The second support shaft 151 passes through a circular hole of the circular plate 41. With this configuration, the detection gear 35 is rotatable about the first axis A1 while being supported by the first support shaft 373 and the second support shaft 151. In this embodiment, the detection gear 35 is positioned at the first exterior surface via the cap 15. The detection gear 35 may be positioned at the first exterior surface without the cap 15. For, example, a shaft may extend from the first exterior surface and the detection gear 35 may be rotatable about the shaft, whereby, the detection gear 35 may be positioned at the first exterior surface.

The first protrusion 43 protrudes outward from an outer circumferential surface of the cylindrical portion 42 in a diameter direction of the cylindrical portion 42. The diameter direction is one example of a radial direction of the detection gear 35. The first protrusion 43 may be attached to the outer circumference of the cylindrical portion 42. The first protrusion 43 has a plate shape extending both in the diameter direction of the cylindrical portion 42 and in the axial direction. The first protrusion 43 has a first surface 61 at a distal end in the diameter direction of the cylindrical portion 42. The first surface 61 is contactable with a detection lever 92 of the image forming apparatus. The first surface 61 is spaced from the second end face of the circular plate 41 in the axial direction. The first surface 61 extends in the circumferential direction of the circular plate 41 along the circumference of the detection gear 35. The first surface 61 also extends in the axial direction. The first protrusion 43 including the first surface 61 is rotatable about the first axis A1 with the circular plate 41 and the cylindrical portion 42. A radial length of the detection gear 35 is greater than a length of the first protrusion 43 in the diameter direction.

The second protrusion 44 protrudes outward from the outer circumferential surface of the cylindrical portion 42 in the diameter direction of the cylindrical portion 42. The second protrusion 44 includes a first arm 441, an arc portion 442, and a second arm 443. The first arm 441 and the second arm 443 each protrude outward from the outer circumferential surface of the cylindrical portion 42 in a respective direction with respect to the diameter direction of the cylindrical portion 42. The first arm 441 and the second arm 443 each have a flat-plate like shape extending in the diameter direction of the cylindrical portion 42. The arc portion 442 has an arc shape and connects between a distal end of the first arm 441 in the diameter direction and a distal end of the second arm 443 in the diameter direction of the cylindrical portion 42. The arc portion 442 has a second surface 62 at a surface that faces outward in the diameter direction of the cylindrical portion 42. The second surface 62 is contactable with the detection lever 92 of the image forming apparatus. The second surface 62 is spaced from the second end face of the circular plate 41 in the axial direction and is connected with the cylindrical portion 42 via the first arm 441 and the second arm 443. The second surface 62 extends along the circumference of the detection gear 35 in the circumferential direction of the circular plate 41. The second surface 62 also extends in the axial direction. The second protrusion 44 including the second surface 62 is rotatable about the first axis A1 with the circular plate 41 and the cylindrical portion 42. A radial length of the detection gear 35 is greater than a length of the second protrusion 44 in the diameter direction.

As depicted in FIGS. 4 and 5, the first surface 61 and the second surface 62 are distant from each other in the circumferential direction of the circular plate 41. In other words, the first surface 61 and the second surface 62 are separate from each other in the circumferential direction of the circular plate 41. The first surface 61 is positioned within a range between the fifth end 541 and the sixth end 542 of the second engagement portion 54 in the circumferential direction of the circular plate 41 (e.g., within an angle range of the first area 51 relative to the first axis A1 in the circumferential direction of the circular plate 41). The second surface 62 is positioned closer to the sixth end 542 than the first surface 61 in the circumferential direction of the circular plate 41. In this embodiment, the second surface 62 extends between the first area 51 and the second area 52 astride the sixth end 542 in the circumferential direction of the circular plate 41. For example, a portion of the second surface 62 is positioned within the range between the fifth end 541 and the sixth end 542 of the second engagement portion 54 in the circumferential direction of the circular plate 41 (e.g., within the angle range of the first area 51 relative to the first axis A1 in the circumferential direction of the circular plate 41), and the other portion of the second surface 62 is positioned out of the range between the fifth end 541 and the sixth end 542 of the second engagement portion 54 in the circumferential direction of the circular plate 41 (e.g., within an angle range of the second area 52 relative to the first axis A1 in the circumferential direction of the circular plate 41).

Nevertheless, in other embodiments, for example, an entire portion of the second surface 62 may be positioned within the range between the fifth end 541 and the sixth end 542 of the second engagement portion 54 in the circumferential direction of the circular plate 41. In other words, both of the first surface 61 and the second surface 62 may be positioned within the angle range of the first area 51 relative to the first axis A1 in the circumferential direction of the circular plate 41.

As depicted in FIGS. 3, 7, 8, 9, 10, and 11, the large-diameter gear 341 of the agitator gear 34 is positioned farther from the first external surface of the casing 10 than the circular plate 41 in the axial direction. Therefore, while a portion of the large-diameter gear 341 of the agitator gear 34 and a portion of the circular plate 41 of the detection gear 35 are aligned with each other in the axial direction and the large-diameter gear 341 is positioned within the rotational circumference defined by rotation of the second engagement portion 54, the large-diameter gear 341 is free from contact with the second engagement portion 54 of the detection gear 35. The large-diameter gear 341 of the agitator gear 34 is positioned closer to the first external surface of the casing 10 than the first surface 61 and the second surface 62 of the detection gear 35 in the axial direction. Therefore, while a portion of the large-diameter gear 341 is positioned both within a rotational circumference defined by rotation of the first surface 61 and within a rotational circumference defined by rotation of the second surface 62, the large-diameter gear 341 is also free from contact with the first surface 61 and the second surface 62. The large-diameter gear 341 is positioned outside of a rotational circumference defined by rotation of the cylindrical portion 42. In this embodiment, as described above, the detection gear 35 has a first clearance between the circular plate 41 and the first protrusion 43 in the axial direction and a second clearance between the circular plate 41 and the second protrusion 44 in the axial direction. A portion of the large-diameter gear 341 passes through the first clearance and the second clearance when the detection gear 35 rotates in the rotational direction.

As depicted in FIG. 4, in the circumferential direction of the circular plate 41, the second surface 62 has a dimension (e.g., a length) greater than the first surface 61 has. The first surface 61 has a first end and a second end in the circumferential direction of the circular plate 41. The first end of the first surface 61 is farther from the second surface 62 (e.g., a leading end of the first surface 61 in the rotational direction of the detection gear 35) than the second end of the first surface 61 in the circumferential direction of the circular plate 41. A virtual line passing the first end of the first surface 61 from the first axis A1 and a virtual line passing the second end of the first surface 61 from the first axis A1 form an angle θ1 relative to the first axis A1. The second surface 62 has a third end and a fourth end in the circumferential direction of the circular plate 41. The third end of the second surface 62 is closer to the first surface 61 (e.g., a leading end of the second surface 62 in the rotational direction of the detection gear 35) than the fourth end of the second surface 61 in the circumferential direction of the circular plate 41. A virtual line passing the third end of the second surface 62 from the first axis A1 and a virtual line passing the fourth end of the second surface 62 from the first axis A1 form an angle θ2 relative to the first axis A1. In this embodiment, the angle θ2 is greater than the angle θ1. The angle θ1 may be 6.40°. The angle θ1 may be, for example, between 6.35° and 6.45° inclusive. The angle θ2 may be 94.4°. The angle θ2 may be, for example, between 93.9° and 94.9° inclusive. The image forming apparatus is configured to detect each of the first surface 61 and the second surface 62 to identify specifications of the developer cartridge 1 based on the detection result.

As depicted in FIG. 4, the virtual line passing the first end of the first surface 61 from the first axis A1 and the virtual line passing the third end of the second surface 62 from the first axis A1 form an angle θ3 relative to the first axis A1. The angle θ3 may be 90.0°. The angle θ3 may be, for example, between 89.5° and 90.5° inclusive.

The virtual line passing the second end of the first surface 61 from the first axis A1 and the virtual line passing the third end of the second surface 62 from the first axis A1 form an angle θ4. The angle θ4 may be 83.6°. The angle θ4 may be, for example, between 83.1° and 84.1° inclusive.

A virtual line passing the fifth end 541 of the first area 51 from the first axis A1 and the virtual line passing the first end of the first surface 61 from the first axis form A1 an angle θ5. The angle θ5 may be 97.9°. The angle θ5 may be, for example, between 97.4° and 98.4° inclusive.

A virtual line passing the sixth end of the first area 542 from the first axis A1 and a virtual line passing the fourth end of the second surface 62 from the first axis A1 form an angle θ6. The angle θ6 may be 29.9°. The angle θ6 may be, for example, between 29.4° and 30.4° inclusive.

The torsion spring 36 is an elastic member configured to press the detection gear 35 in the rotational direction. As depicted in FIGS. 1, 2, and 3, the casing 10 includes a spring retainer 14. The spring retainer 14 is positioned opposite side of the toner chamber 11 with respect to the first exterior surface in the axial direction. The spring retainer 14 has a flat-plate like shape. The spring retainer 14 protrudes from the first exterior surface in the axial direction. The torsion spring 36 includes one end, which is in contact with the spring retainer 14. The torsion spring 36 includes the other end, which is in contact with the detection gear 35. The torsion spring 36 is positioned between the spring retainer 14 and the detection gear 35 with being compressed. Therefore, the other end of the torsion spring 36 applies its elastic force acting in the rotational direction to the detection gear 35.

Figure 7:
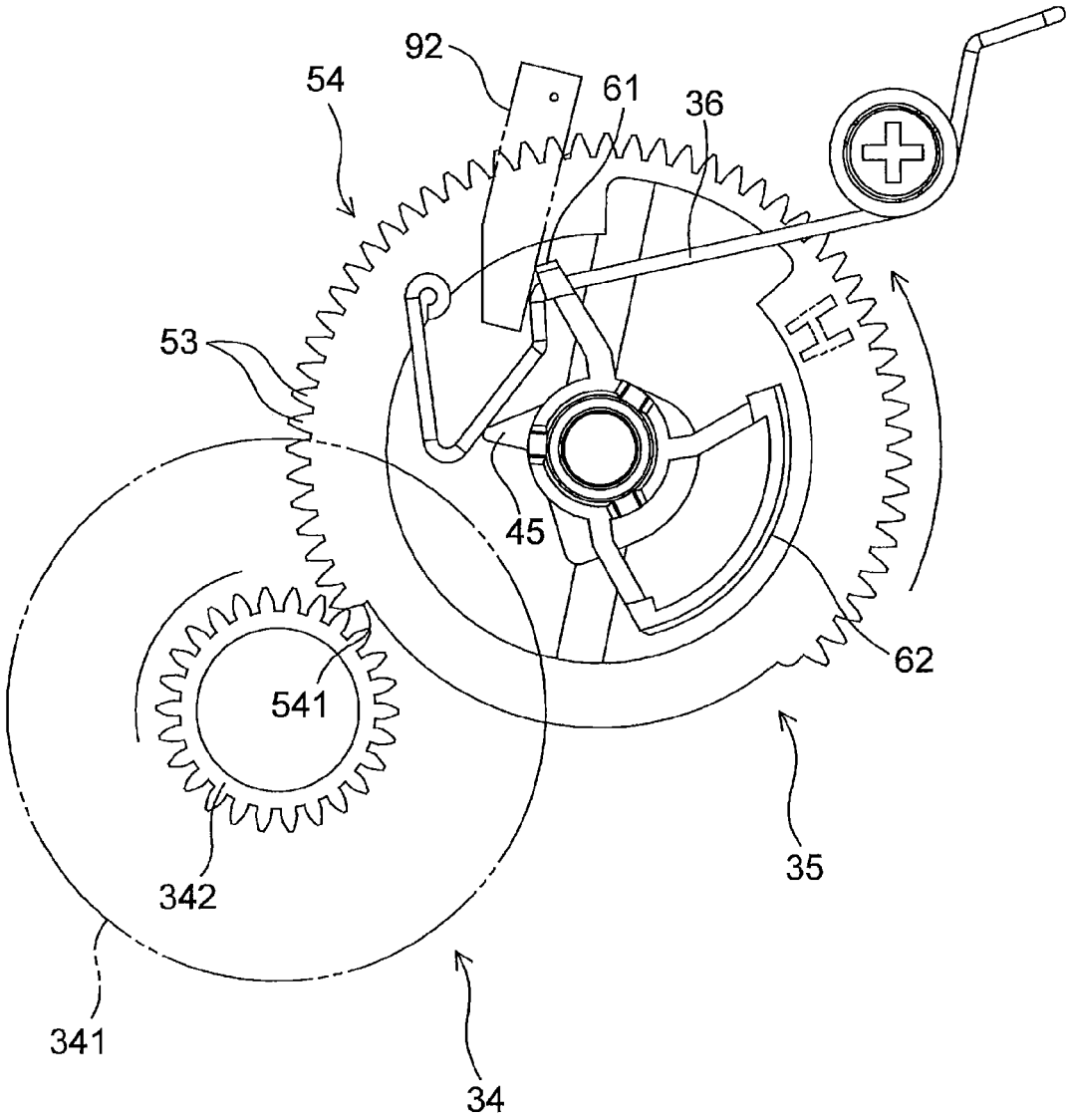
FIG. 7 illustrates an initial rotational state of the detection gear.

The detection gear 35 further includes a specific protrusion 45. The specific protrusion 45 is contactable with the torsion spring 36 before the detection gear 35 starts rotating and when the detection gear 35 is in an initial rotational state. The initial rotational state refers to a state of the detection gear 35 immediately after the detection gear 35 starts rotating. A distance between the first exterior surface of the casing 10 and the specific protrusion 45 in the axial direction is greater than a distance between the first exterior surface of the casing 10 and the circular plate 41 in the axial direction. The distance between the first exterior surface of the casing 10 and the specific protrusion 45 in the axial direction is less than a distance between the first exterior surface of the casing 10 and the first protrusion 43 in the axial direction. The distance between the first exterior surface of the casing 10 and the specific protrusion 45 in the axial direction is less than a distance between the first exterior surface of the casing 10 and the second protrusion 44 in the axial direction. The specific protrusion 45 protrudes outward from the cylindrical portion 42 in the diameter direction of the cylindrical portion 42. As depicted in FIG. 7, before the detection gear 35 starts rotating, a portion of the other end of the torsion spring 36 is in contact with a trailing end face of the specific protrusion 45 in the rotational direction. Thus, the detection gear 35 is pressed in the rotational direction due to the elastic force of the torsion spring 36, whereby the fifth end 541 of the second engagement portion 54 is kept in contact with the small-diameter gear 342 of the agitator gear 34.

The detection gear 35 further includes a specific protrusion 46. The specific protrusion 46 is contactable with the torsion spring 36 at the time after the detection gear 35 stops rotating. A distance between the first exterior surface of the casing 10 and the specific protrusion 46 in the axial direction is greater than the distance between the first exterior surface of the casing 10 and the circular plate 41 in the axial direction. The distance between the first exterior surface of the casing 10 and the specific protrusion 46 in the axial direction is less than the distance between the first exterior surface of the casing 10 and the first protrusion 43 in the axial direction. The distance between the first exterior surface of the casing 10 and the specific protrusion 46 in the axial direction is less than the distance between the first exterior surface of the casing 10 and the second protrusion 44 in the axial direction. The specific protrusion 46 is distant from the specific protrusion 45 in the circumferential direction of the circular plate 41. In other words, the specific protrusion 46 may be separate from the specific protrusion 45 in the circumferential direction of the circular plate 41. The specific protrusion 46 protrudes outward from the cylindrical portion 42 in the diameter direction. After the detection gear 35 stops rotating, the other end of the torsion spring 36 is in contact with a trailing end face of the specific protrusion 46 in the rotational direction. Thus, the detection gear 35 is pressed in the rotational direction due to the elastic force of the torsion spring 36, whereby the second engagement portion 54 is kept separate or disengaged from the small-diameter gear 342 of the agitator gear 34.

Figure 6:
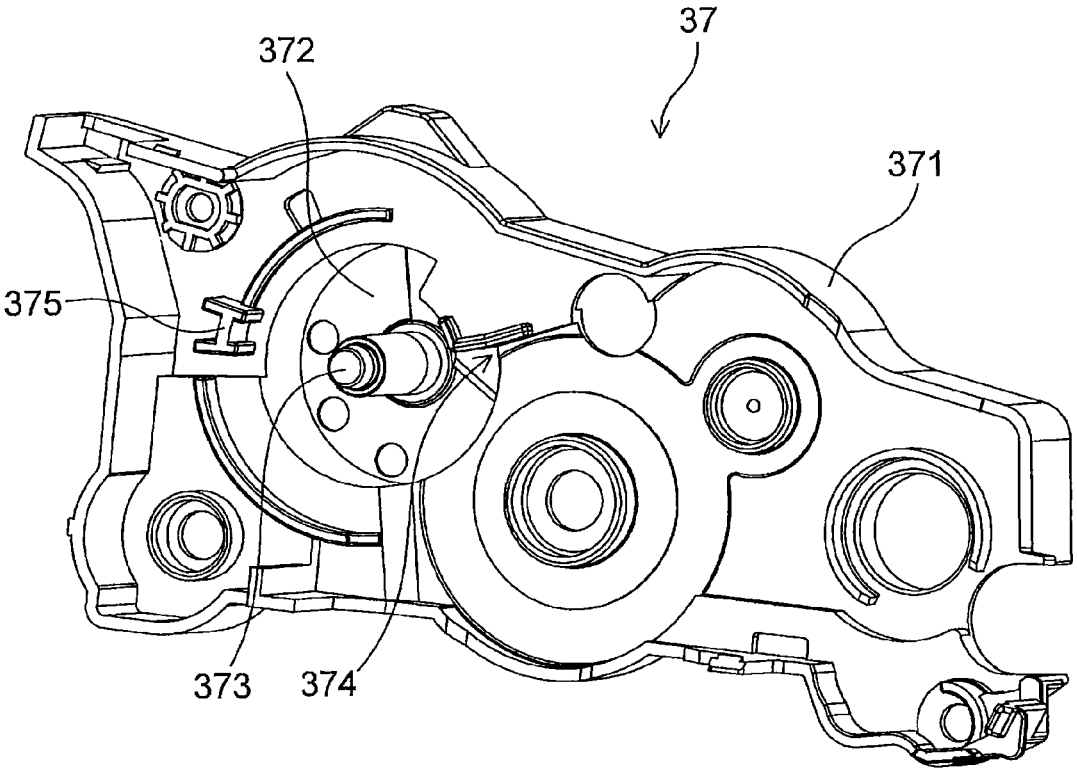
FIG. 6 is a perspective view of the gear cover.

The gear cover 37 is configured to cover at least a portion of the gears 31, 32, 33, 34, and 35. For example, the gear cover 37 may cover at least one of the gears 31, 32, 33, 34, and 35 or may cover a portion of at least one the gears 31, 32, 33, 34, and 35. FIG. 6 is a perspective view of the gear cover 37 with its inner surface revealed. As depicted in FIGS. 2 and 6, the gear cover 37 includes a cover body 371 and a protrusion accommodating portion 372. The protrusion accommodating portion 372 has a cup-like shape. The protrusion accommodating portion 372 is recessed outward in the axial direction relative to the cover body 371. The first protrusion 43 and the second protrusion 44 of the detection gear 35 are accommodated in the protrusion accommodating portion 372. The gear cover 37 further includes the first support shaft 373. The first support shaft 373 has a cylindrical shape and protrudes inward in the axial direction from a middle portion of the protrusion accommodating portion 372. As described above, the first support shaft 373 passes through the through hole 420 of the cylindrical portion 42 of the detection gear 35.

The protrusion accommodating portion 372 has an opening 374 at a position corresponding to a portion of a circumference of the detection gear 35 in the circumferential direction of the circular plate 41. The opening 374 penetrates the protrusion accommodating portion 372 both in a diameter direction of the protrusion accommodating portion 372 and in the axial direction. In a state where the developer cartridge 1 is attached to the image forming apparatus, the detection lever 92 of the image forming apparatus is positioned at the opening 374 of the protrusion accommodating portion 372 while passing therethrough. As depicted in FIG. 3, before the detection gear 35 starts rotating, the first protrusion 43 is positioned closer to the opening 374 than the second protrusion 44. As the detection gear 35 rotates in the rotational direction, the first surface 61 of the first protrusion 43 comes to expose from the opening 374 and comes into contact with the detection lever 92. Thereafter, the second surface 62 of the second protrusion 44 comes to expose from the opening 374 and contact with the detection lever 92.

As depicted in FIG. 2 and FIG. 3, a fourth protrusion 70 is positioned at the first exterior surface. The fourth protrusion 70 extends in the axial direction. More specifically, the fourth protrusion 70 extends outward from the first exterior surface. The fourth protrusion 70 may be attached as separate member to the first exterior surface. Alternatively, the fourth protrusion 70 may be attached to the first exterior surface via another member. The fourth protrusion 70 may be fixed to the first exterior surface.

The fourth protrusion 70 has a U-shape when viewed in the axial direction. The fourth protrusion 70 has a shape allowing a pressing force to be received from a drum cartridge. The developer cartridge 1 may be mounted to the drum cartridge, when the developer cartridge 1 is mounted to the image forming apparatus. After the developer cartridge 1 is attached to the drum cartridge, the developer cartridge 1 is mounted to the image forming apparatus with the drum cartridge. Specifically, the fourth protrusion 70 has a surface for receiving the pressing force. More specifically, the fourth protrusion 70 has a curved surface. The curved surface is curved in a direction from the developing roller 20 to the fourth protrusion 70. When a pressing member (not depicted in the drawings) provided at the drum cartridge contacts the curved surface, the curved surface can receive suitably a pressing force from the pressing member toward the photosensitive drum. A compressed spring is one example of the pressing member. The compressed spring has a length L1 when the developing cartridge 1 is not mounted to the drum cartridge. When the developing cartridge 1 is mounted to the drum cartridge, the compressed spring urges the curved surface toward the photosensitive drum. When the developing cartridge 1 is mounted to the drum cartridge, the compressed spring urges the fourth protrusion 70 and a length of the compressed spring is shorter than the length L1. More specifically, when the developing cartridge 1 is mounted to the drum cartridge, a pressing surface of the pressing member contacts the curved surface of the fourth protrusion 70 and a length of the compressed spring is shorter than the length L1. Through this contact, the compressed spring urges the pressing surface to press the fourth protrusion 70 toward the photosensitive drum.

The fourth protrusion 70 is positioned between the second axis A2 and the fourth axis A4 in a direction connecting to the second axis A2 and the fourth axis A4. The fourth protrusion 70 is positioned outside a rotational circumference of the detection gear 35 defined by rotation of the detection gear 35. The fourth protrusion 70 is positioned outside of a rotational circumference of the small-diameter gear 342 defined by rotation of the small-diameter gear 342. The fourth protrusion 70 is positioned outside of a rotational circumference of the large-diameter gear 341 defined by rotation of the large-diameter gear 341. The fourth protrusion 70 is positioned outside of a rotational circumference of the output gear 332 defined by rotation of the output gear 332. The fourth protrusion 70 is positioned outside of a rotational circumference of the coupling gear 311 defined by rotation of the coupling gear 311. A distal end of the fourth protrusion 70 is closer to the first exterior surface than an edge of the large-diameter gear 341 that faces the first exterior surface in the axial direction. In other words, the distal end of the fourth protrusion 70 is spaced apart from an edge of the large-diameter gear 341 that faces the first exterior surface in the axial direction. A length of the fourth protrusion 70 extending from the first exterior surface in the axial direction is shorter than a distance between the first exterior surface and an edge of the large-diameter gear 341 that faces the first exterior surface in the axial direction. Therefore, the fourth protrusion 70 does not prevent the gear unit 30 from rotating.

<4. Behavior of Detection Gear after Attachment of Developer Cartridge>

Figure 10:
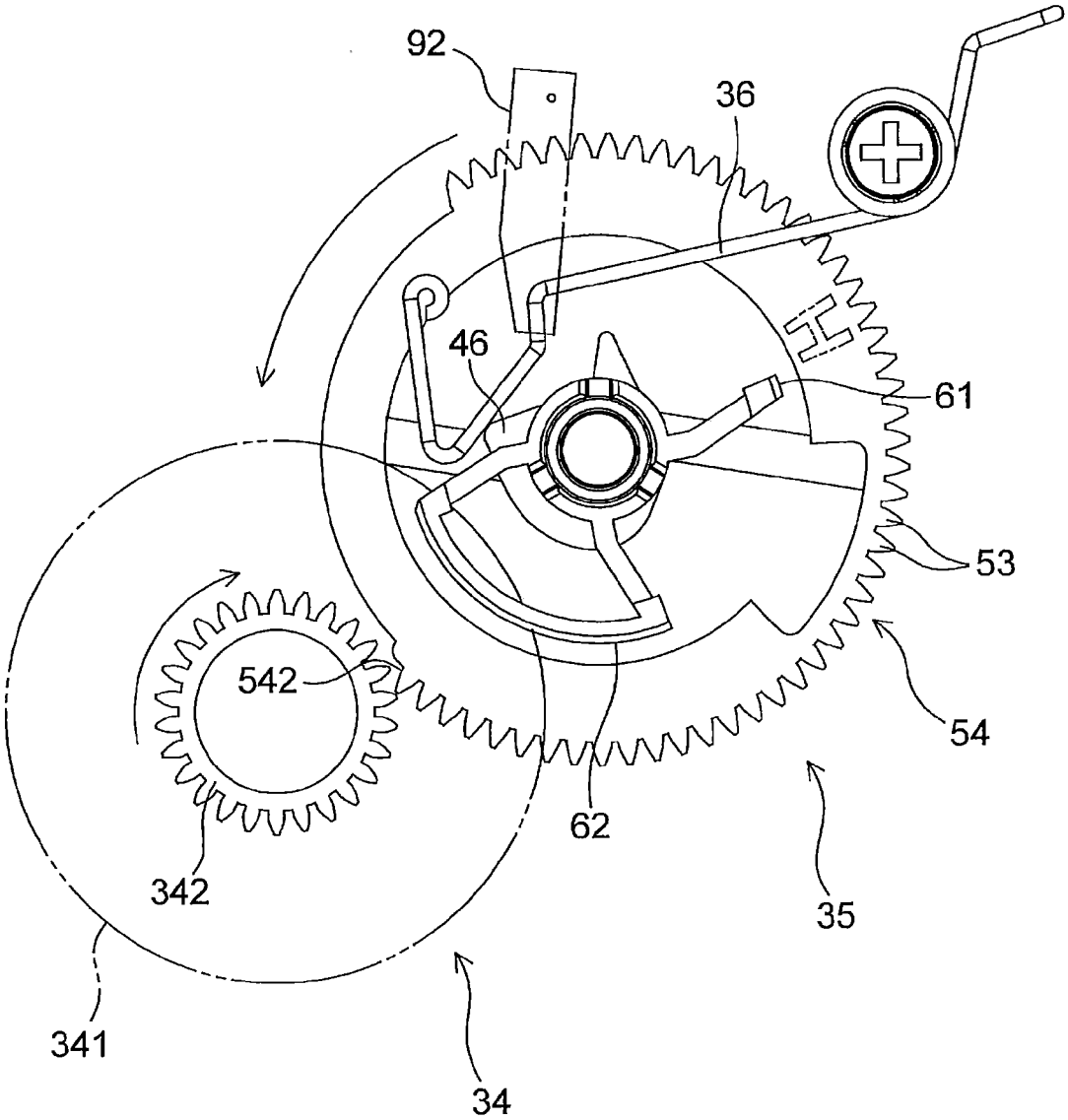
FIG. 10 illustrates other rotational state of the detection gear.
Figure 11:
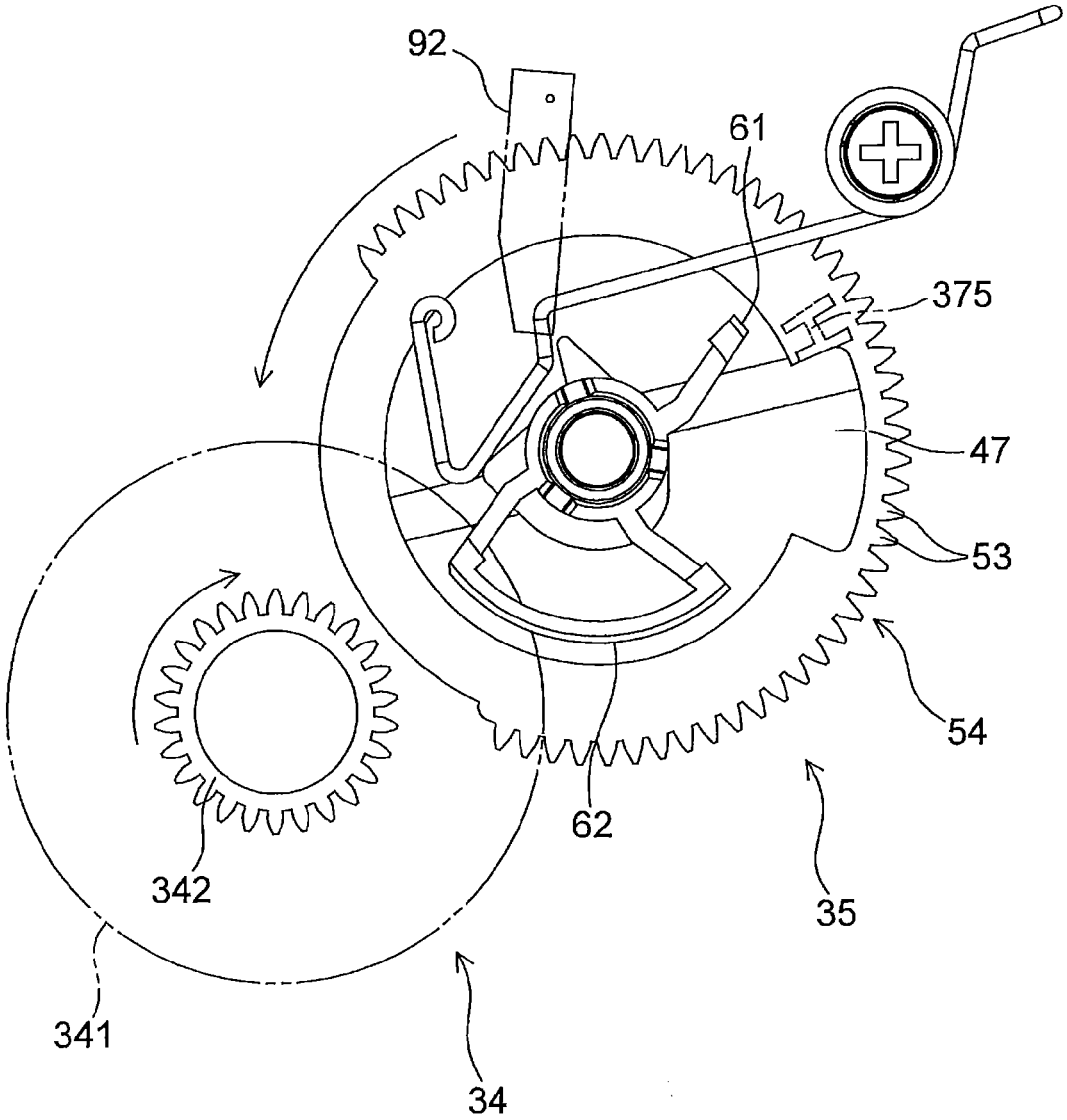
FIG. 11 illustrates a state of the detection gear after the detection gear stops rotating.
Figure 12:
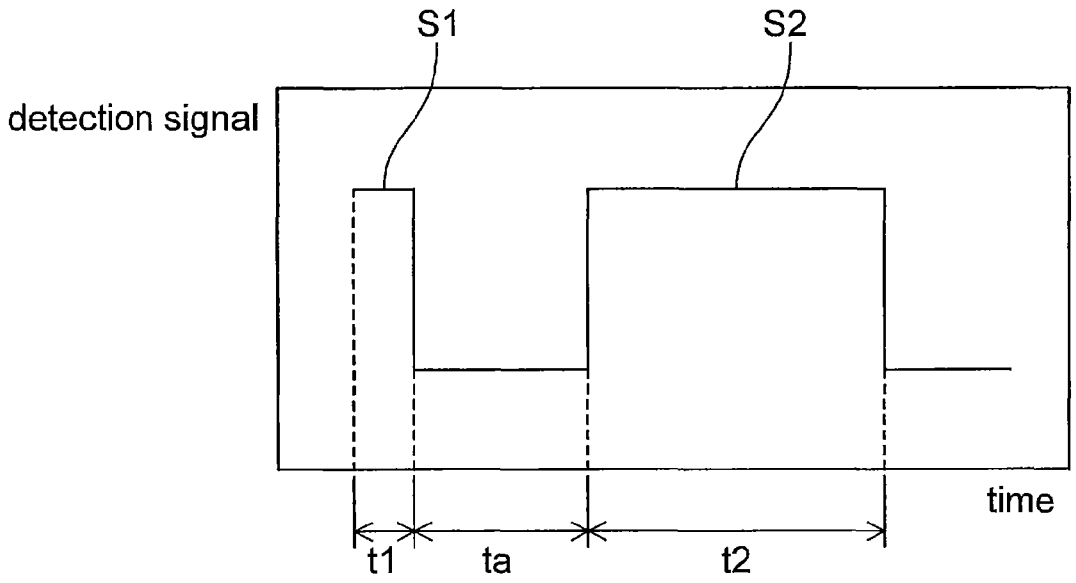
FIG. 12 is a graph showing a detection signal pattern.

Referring to FIGS. 7, 8, 9, 10, and 11, a description will be provided on how the detection gear 35 behaves after the developer cartridge 1 is attached to the image forming apparatus. FIGS. 7, 8, 9, 10, and 11 illustrate different states of the detection gear 35 after the developer cartridge 1 is attached to the image forming apparatus. As a driving force is applied to the coupling 31, the detection gear 35 rotates in the rotational direction to change its state to the initial rotational state depicted in FIG. 7. As the detection gear 35 further rotates in the rotational direction, the detection gear 35 changes its state from the initial rotational state to a state depicted in FIG. 11 through rotational states depicted in FIGS. 8, 9, and 10 in this order. FIG. 12 is a graph showing a detection signal pattern received by the image forming apparatus in accordance with rotation of the detection gear 35.

As depicted in FIG. 7, when the detection gear 35 is in the initial rotational state, the fifth end 541 of the second engagement portion 54 is positioned within the rotational circumference defined by rotation of the small-diameter gear 342 of the agitator gear 34 while the sixth end 542 of the second engagement portion 54 is positioned outside of the rotational circumference defined by rotation of the small-diameter gear 342. In this state, the fifth end 541 of the detection gear 35 is kept in contact with the small-diameter gear 342 of the agitator gear 34 due to the elastic force of the torsion spring 36. In this state, one or more of the teeth 53 of the second engagement portion 54 and one or more of the teeth of the small-diameter gear 342 may be in mesh with each other or may be in contact with each other.

In the initial rotational state of FIG. 7, the first surface 61 is exposed through the opening 374 of the gear cover 37 while the second surface 62 is concealed. The first surface 61 then comes into contact with the detection lever 92 which constitutes a portion of the image forming apparatus while the second surface 62 does not come into contact with the detection lever 92.

As the drive shaft 91 rotates, the agitator gear 34 rotates by a driving force transmitted thereto via the coupling 31 and the idle gear 33. Upon rotation of the agitator gear 34, one or more of the teeth of the small-diameter gear 342 of the agitator gear 34 and one or more of the teeth 53 of the second engagement portion 54 come into mesh with each other, whereby the detection gear 35 starts rotating. In this embodiment, the first surface 61 is kept in contact with the detection lever 92 for a certain time from the initial rotational state. Hereinafter, the position where the detection gear 35 is positioned while the first surface 61 is in contact with the detection lever 92 is referred to as a first position.

Figure 8:
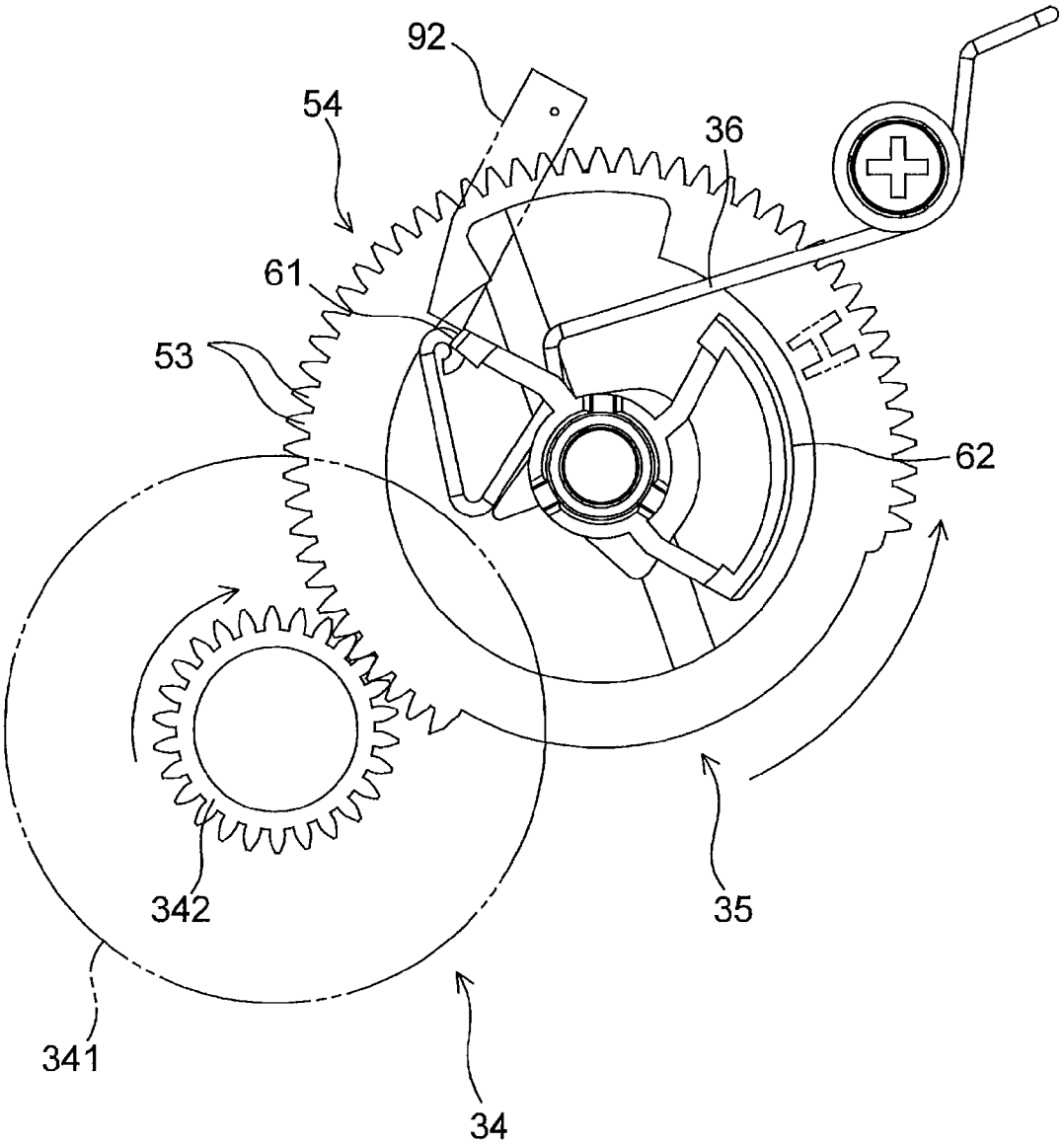
FIG. 8 illustrates another rotational state of the detection gear.

When the detection gear 35 is positioned at the first position, as depicted in FIGS. 7 and 8, the detection lever 92 is displaced from a normal position due to pressing by the first surface 61. For example, the detection lever 92 is pressed by the first surface 61 while a distal end portion of the detection lever 92 is in contact with the first surface 61. Therefore, an inclination degree of the detection lever 92 relative to the image forming apparatus is changed. At that time, the image forming apparatus receives a first detection signal S1 outputted in accordance with the displacement of the detection lever 92. For example, as depicted in FIG. 12, the image forming apparatus may receive a pulsed first detection signal S1 in accordance with the displacement of the detection lever 92. A duration t1 of the first detection signal S1 corresponds to the length of the first surface 61 of the detection gear 35 in the circumferential direction of the circular plate 41. As the first surface 61 disengages from the detection lever 92, the detection lever 92 returns to the normal position and the output of the first detection signal S1 is stopped. When the detection gear 35 is positioned at a second position or at a third position, the first surface 61 is not in contact with the detection lever 92.

Figure 9:
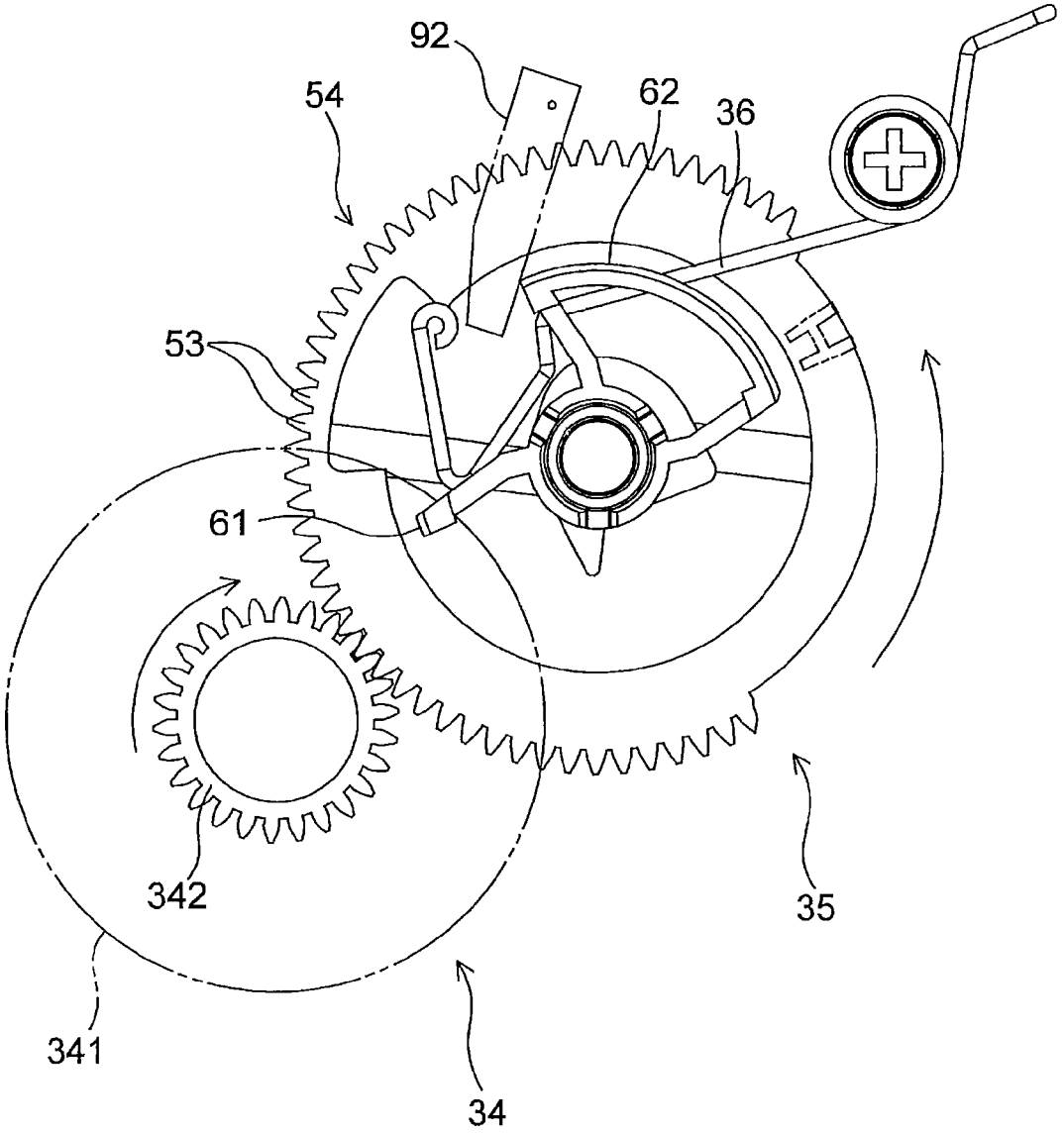
FIG. 9 illustrates still another rotational state of the detection gear.

As the detection gear 35 further rotates in the rotational direction from the first position, the second surface 62 of the detection gear 35 comes to expose from the opening 374 of the gear cover 37. Then, as depicted in FIG. 9, the second surface 62 comes into contact with the detection lever 92. In this embodiment, the second surface 62 is kept in contact with the detection lever 92 for a certain time from the rotational state depicted in FIG. 9. Hereinafter, the position where the detection gear 35 is positioned while the second surface 62 is in contact with the detection lever 92 is referred to as the second position.

When the detection gear 35 is positioned at the second position, as depicted in FIG. 9, the detection lever 92 is displaced from the normal position due to pressing by the second surface 62. For example, the detection lever 92 is pressed by the second surface 62 while the distal end portion of the detection lever 92 is in contact with the second surface 62. Therefore, the inclination degree of the detection lever 92 relative to the image forming apparatus is changed. At that time, the image forming apparatus receives a second detection signal S2 outputted in accordance with the displacement of the detection lever 92. For example, as depicted in FIG. 12, the image forming apparatus may receive a pulsed second detection signal S2 due to the displacement of the detection lever 92. A duration t2 of the second detection signal S2 corresponds to the length of the second surface 62 in the circumferential direction of the circular plate 41. Thus, the duration t2 of the second detection signal S2 is longer than the duration t1 of the first detection signal S1.

A time interval to between the first detection signal S1 and the second detection signal S2 corresponds to a distance in the circumferential direction of the circular plate 41 between the second end of the first surface 61 and the third end of the second surface 62. The image forming apparatus identifies the specifications of the developer cartridge 1 based on the obtained information, e.g., the duration t1 of the first detection signal S1, the duration t2 of the second detection signal S2, and the time interval to between the detection signals S1 and S2. Then, as the second surface 62 disengages from the detection lever 92, the detection lever 92 returns to the normal position and the output of the second detection signal S2 is stopped.

As the detection gear 35 further rotates in the rotational direction from the second position, as depicted in FIG. 10, the sixth end 542 of the second engagement portion 54 passes the small-diameter gear 342. Thus, the small-diameter gear 342 and the second engagement portion 54 disengage from each other, whereby the transmission of the driving force from the agitator gear 34 to the detection gear 35 is stopped. After the small-diameter gear 342 and the second engagement portion 54 disengage from each other, the torsion spring 36 presses the specific protrusion 46 of the detection gear 35 in the rotational direction. Thus, the detection gear 35 further rotates to the third position (refer to FIG. 11) by the elastic force of the torsion spring 36, and the second engagement portion 54 is kept separate from the small-diameter gear 342.

As depicted in FIGS. 4 and 5, the detection gear 35 further includes a first stopper protrusion 47. A distance in the axial direction between the first exterior surface of the casing 10 and the first stopper protrusion 47 is greater than the distance in the axial direction between the first exterior surface of the casing 10 and the circular plate 41. The distance in the axial direction between the first exterior surface of the casing 10 and the first stopper protrusion 47 is less than the distance in the axial direction between the first exterior surface of the casing 10 and the first protrusion 43. The distance in the axial direction between the first exterior surface of the casing 10 and the first stopper protrusion 47 is less than the distance in the axial direction between the first exterior surface of the casing 10 and the second protrusion 44. The first stopper protrusion 47 extends outward in the diameter direction of the circular plate 41. As depicted in FIG. 6, the gear cover 37 includes a second stopper protrusion 375. The second stopper protrusion 375 protrudes in the axial direction from an inner surface of the cover body 371. When the detection gear 35 is positioned at the third position, as depicted in FIG. 11, a leading end face of the first stopper protrusion 47 of the detection gear 35 in the rotational direction is in contact with the second stopper protrusion 375 of the gear cover 37. Accordingly, the detection gear 35 is restricted from further rotating in the rotational direction, thereby being retained at the third position.

When the detection gear 35 is positioned at the third position, none of the teeth 53 of the second engagement portion 54 of the detection gear 35 is in contact with any of the teeth of the small-diameter gear 342 of the agitator gear 34. When the detection gear 35 is positioned at the third position, none of the first surface 61 and the second surface 62 is in contact with the detection lever 92.

As described above, as a driving force is applied to the gear unit 30 after the developer cartridge 1 is attached to the image forming apparatus, the detection gear 35 rotates in the rotational direction by a certain angle and then stops rotating. While the detection gear 35 rotates in the rotational direction, the image forming apparatus receives a detection signal generated in accordance with the displacement of the detection lever 92 caused by each of the first surface 61 and the second surface 62 of the detection gear 35. In a case where such a detection signal is generated, the image forming apparatus determines that the currently-attached developer cartridge 1 is a new (or not-yet-used) developer cartridge. The image forming apparatus further determines the specifications (e.g., a toner amount and/or the number of pages that can be printed) of the currently-attached developer cartridge 1 based on the first detection signal S1 and the second detection signal S2.

Especially, immediately after the gear unit 30 is started driven, the number of revolutions of a motor of the image forming apparatus (e.g., a drive source) may be unstable. Therefore, a duration in which the second detection signal S2 is detected can be more precisely detected than the first detection signal S1 that is detected prior to the second detection signal S2. Accordingly, in this embodiment, the second surface 62, which comes into contact with the detection lever 92 subsequent to the first surface 61, has a greater length in the circumferential direction of the circular plate 41 than the first surface 61 has. With this configuration, the image forming apparatus can receive the second detection signal S2 while the detection gear 35 rotates stably. Thus, for example, the image forming apparatus can identify the specifications of the developer cartridge 1 accurately based on the time interval to and the duration t2 of the second detection signal S2 while using the first detection signal S1 as a reference pulse.

<5. Other Example Detection Gears>

Referring to FIGS. 13, 15, 17, 20, 21 and 22 other example detection gears each having a configuration different from the detection gear 35 of the embodiment will be described. The image forming apparatus can receive, from each of the detection gears depicted in FIG. 13, 15, or 17, another detection signal that is distinguishable from the detection signal of FIG. 12.

Figure 13:
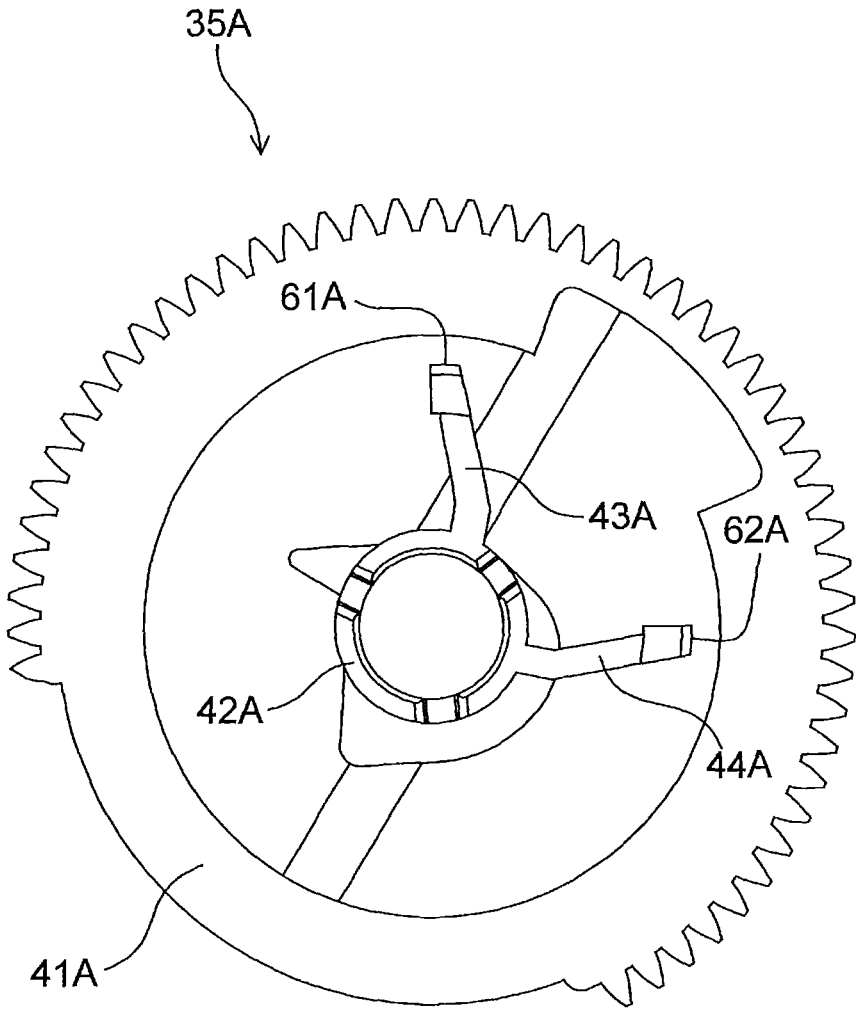
FIG. 13 illustrates another detection gear.
Figure 20:
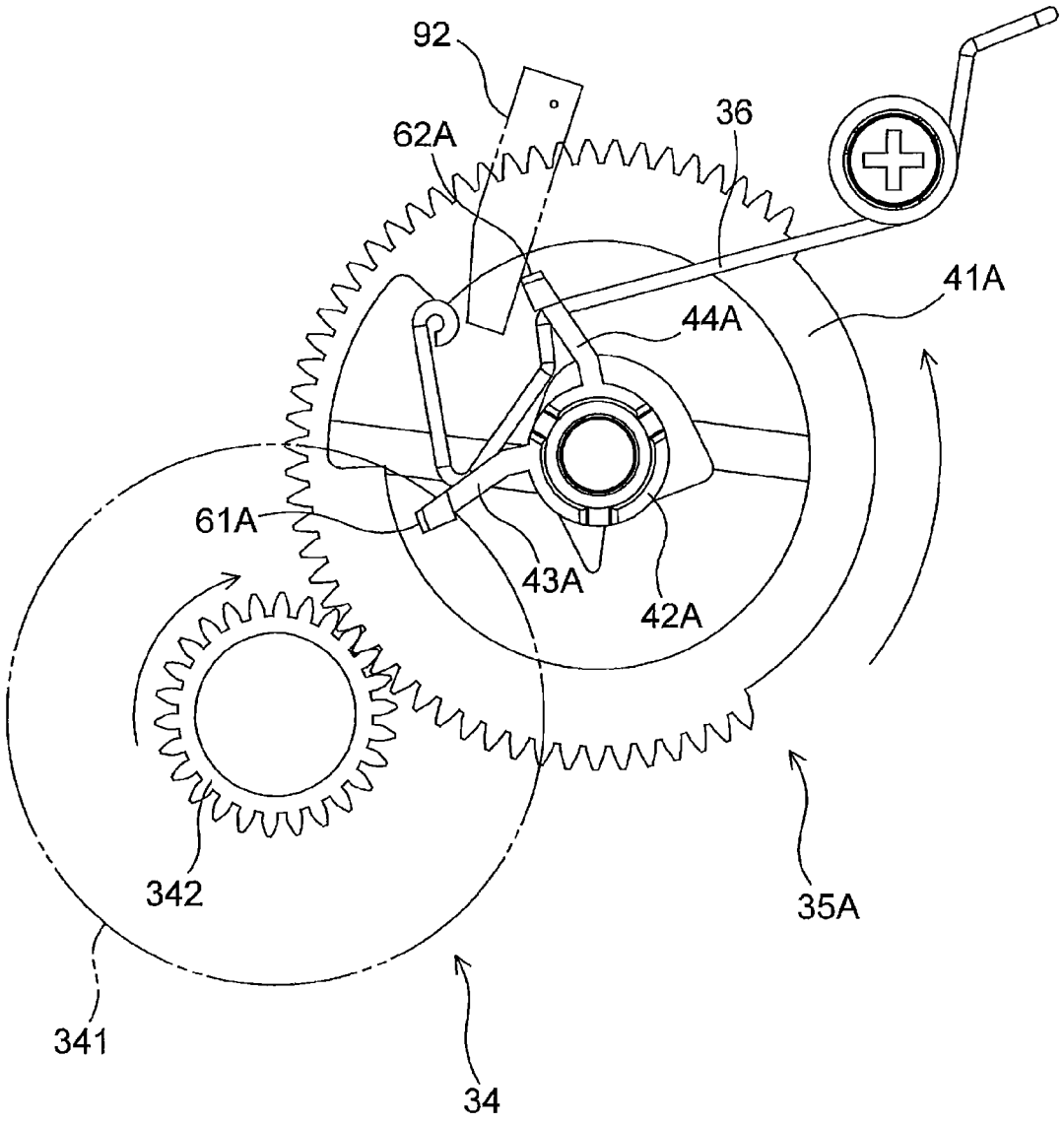
FIG. 20 illustrates a rotational state of another detection gear.

In one example, as depicted in FIGS. 13 and 20, a detection gear 35A includes a circular plate 41A, a cylindrical portion 42A, a first protrusion 43A, and a second protrusion 44A. The circular plate 41A and the cylindrical portion 42A have the same or similar configurations to the circular plate 41 and the cylindrical portion 42, respectively, of the detection gear 35.

The first protrusion 43A and the second protrusion 44A protrude outward from an outer circumferential surface of the cylindrical portion 42A in respective directions with respect to a diameter direction of the circular plate 41A. The first protrusion 43A has a first surface 61A at a distal end in the diameter direction of the circular plate 41A. The first surface 61A is contactable with a detection lever of an image forming apparatus. The second protrusion 44A has a second surface 62A at a distal end in the diameter direction of the circular plate 41A. The second surface 62A is contactable with the detection lever subsequent to the first surface 61A. The first protrusion 43A and the second protrusion 44A are rotatable with the circular plate 41A and the cylindrical portion 42A. A radial length of the detection gear 35A is greater than a length of the first protrusion 43A in the diameter direction. A radial length of the detection gear 35A is greater than a length of the second protrusion 44A in the diameter direction.

As depicted in FIGS. 13 and 20, the first surface 61A and the second surface 62A are spaced away from each other in a circumferential direction of the circular plate 41A. The first surface 61A has a length in the circumferential direction of the circular plate 41A that is substantially the same as the length of the first surface 61 in the circumferential direction of the circular plate 41. A distance in the circumferential direction of the circular plate 41A between the first surface 61A and the second surface 62A is substantially the same as the distance in the circumferential direction of the circular plate 41 between the first surface 61 and the second surface 62 of the detection gear 35. As depicted in FIGS. 13 and 20, in the detection gear 35A, the first surface 61A and the second surface 62A have substantially the same lengths in the circumferential direction of the circular plate 41A.

Figure 14:
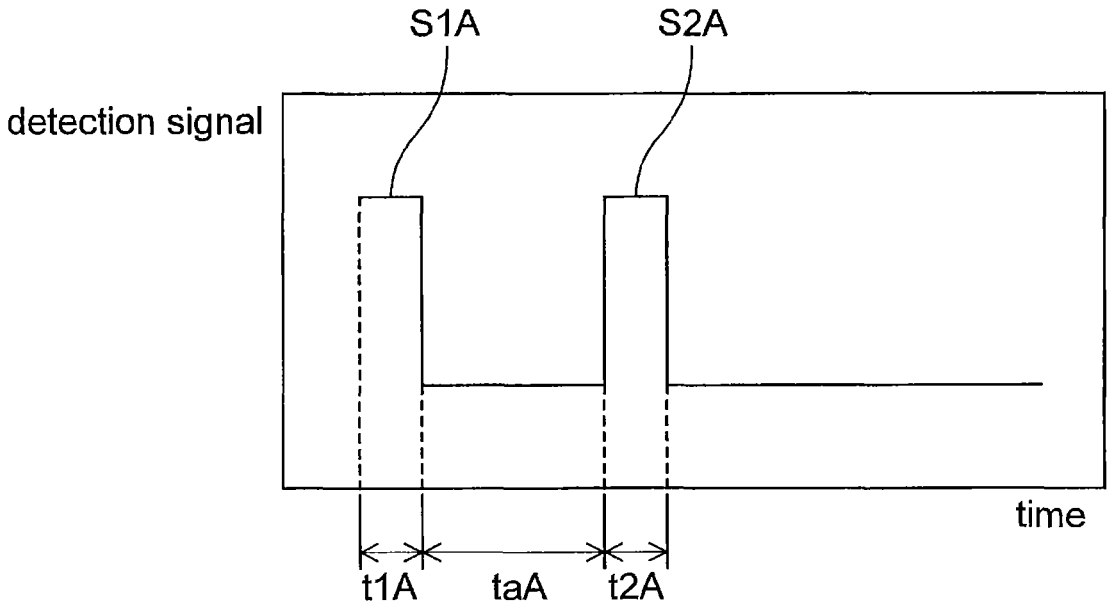
FIG. 14 is a graph showing another detection signal pattern.

FIG. 14 is a graph showing a detection signal pattern received by the image forming apparatus in accordance with rotation of the detection gear 35A of FIG. 13. In a case where the detection gear 35 is used, as depicted in FIG. 12, the duration t2 of the second detection signal S2 corresponding to the second surface 62 is longer than the duration t1 of the first detection signal S1 corresponding to the first surface 61. In a case where the detection gear 35A of FIG. 13 is used, as depicted in FIG. 14, a duration t1A of a first detection signal S1A corresponding to the first surface 61A is substantially the same as a duration t2 of a second detection signal S2 corresponding to the second surface 62. Therefore, the image forming apparatus can distinguish the detection signal of FIG. 12 and the detection signal of FIG. 14 from each other. A time interval taA between the first detection signal S1A and the second detection signal S2A is substantially the same as the time interval to between the first detection signal S1 and the second detection signal S2 of FIG. 12.

For example, a developer cartridge 1 having a first specification is equipped with the detection gear 35 and another developer cartridge having a second specification that is different from the first specification is equipped with the detection gear 35A. In this case, the image forming apparatus can distinguish the developer cartridges from each other based on the received detection signals that are different from each other.

Figure 15:
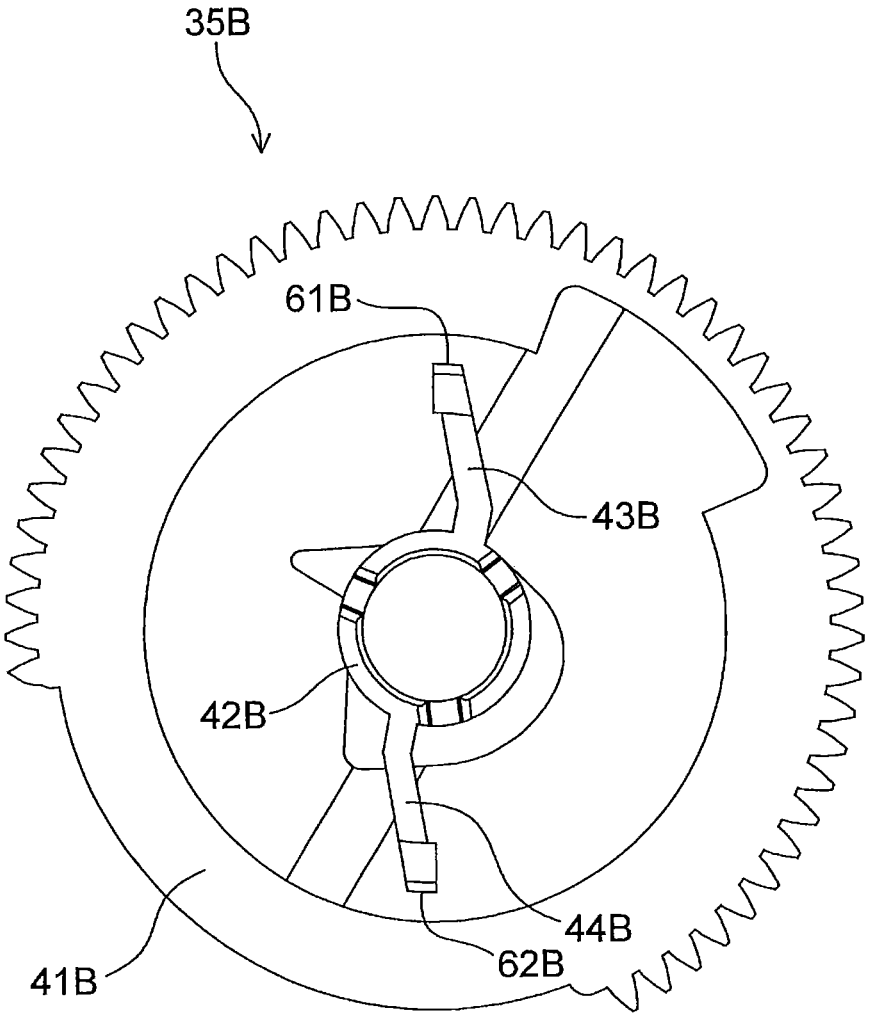
FIG. 15 illustrates still another detection gear.
Figure 21:
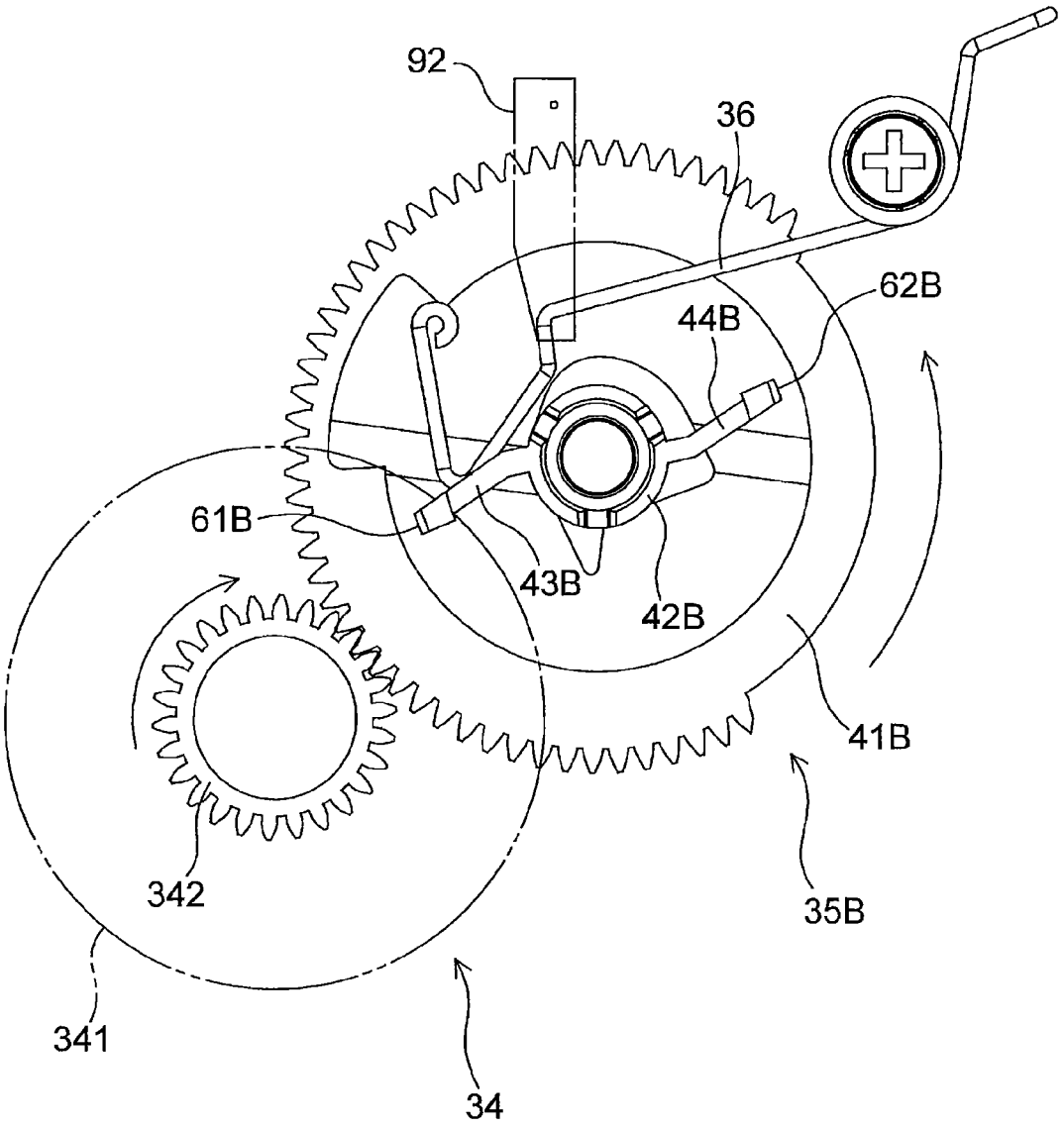
FIG. 21 illustrates a rotational state of still another detection gear.

In another example, as depicted in FIGS. 15 and 21, a detection gear 35B includes a circular plate 41B, a cylindrical portion 42B, a first protrusion 43B, and a second protrusion 44B. The circular plate 41B and the cylindrical portion 42B have the same or similar configurations to the circular plate 41 and the cylindrical portion 42, respectively, of the detection gear 35.

The first protrusion 43B and the second protrusion 44B protrude outward from an outer circumferential surface of the cylindrical portion 42B in respective directions with respect to a diameter direction of the circular plate 41B. The first protrusion 43B has a first surface 61B at a distal end in the diameter direction of the circular plate 41B. The first surface 61B is contactable with a detection lever of an image forming apparatus. The second protrusion 44B has a second surface 62B at a distal end in the diameter direction of the circular plate 41B. The second surface 62B is contactable with the detection lever subsequent to the first surface 61B. The first protrusion 43B and the second protrusion 44B are rotatable with the circular plate 41B and the cylindrical portion 42B. A radial length of the detection gear 35B is greater than a length of the first protrusion 43B in the diameter direction. A radial length of the detection gear 35B is greater than a length of the second protrusion 44B in the diameter direction.

As depicted in FIGS. 15 and 21, the first surface 61B and the second surface 62B are spaced away from each other in a circumferential direction of the circular plate 41B. The first surface 61B has a length in the circumferential direction of the circular plate 41B that is substantially the same as the length of the first surface 61 of the embodiment in the circumferential direction of the circular plate 41B. The first surface 61B and the second surface 62B have substantially the same lengths in the circumferential direction of the circular plate 41B. A distance in the circumferential direction of the circular plate 41B between the first surface 61B and the second surface 62B is greater than the distance in the circumferential direction of the circular plate 41B between the first surface 61 and the second surface 62 of the detection gear 35.

Figure 16:
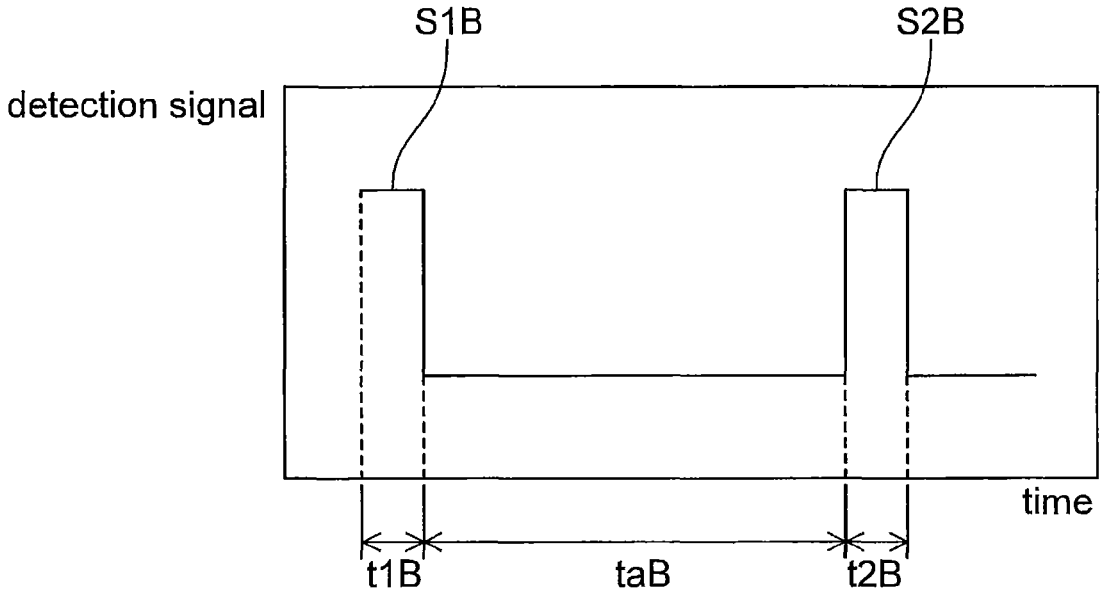
FIG. 16 is a graph showing still another detection signal pattern.

FIG. 16 is a graph showing a detection signal pattern received by the image forming apparatus in accordance with rotation of the detection gear 35B of FIG. 15. In a case where the detection gear 35 is used, as depicted in FIG. 12, the duration t2 of the second detection signal S2 corresponding to the second surface 62 is longer than the duration t1 of the first detection signal S1 corresponding to the first surface 61. In a case where the detection gear 35B of FIG. 15 is used, as depicted in FIG. 16, a duration t1B of a first detection signal S1B corresponding to the first surface 61B is substantially the same as a duration t2B of a second detection signal S2B corresponding to the second surface 62B, and a time interval taB between the first detection signal S1B and the second detection signal S2B is longer than the time interval to between the first detection signal S1 and the second detection signal S2 of FIG. 12. Therefore, the image forming apparatus can distinguish the detection signal of FIG. 12 and the detection signal of FIG. 16 from each other.

For example, a developer cartridge 1 having a first specification is equipped with the detection gear 35 and another developer cartridge having a third specification that is different from the first specification is equipped with the detection gear 35B. In this case, the image forming apparatus can distinguish the developer cartridges from each other based on the received detection signals that are different from each other.

Figure 17:
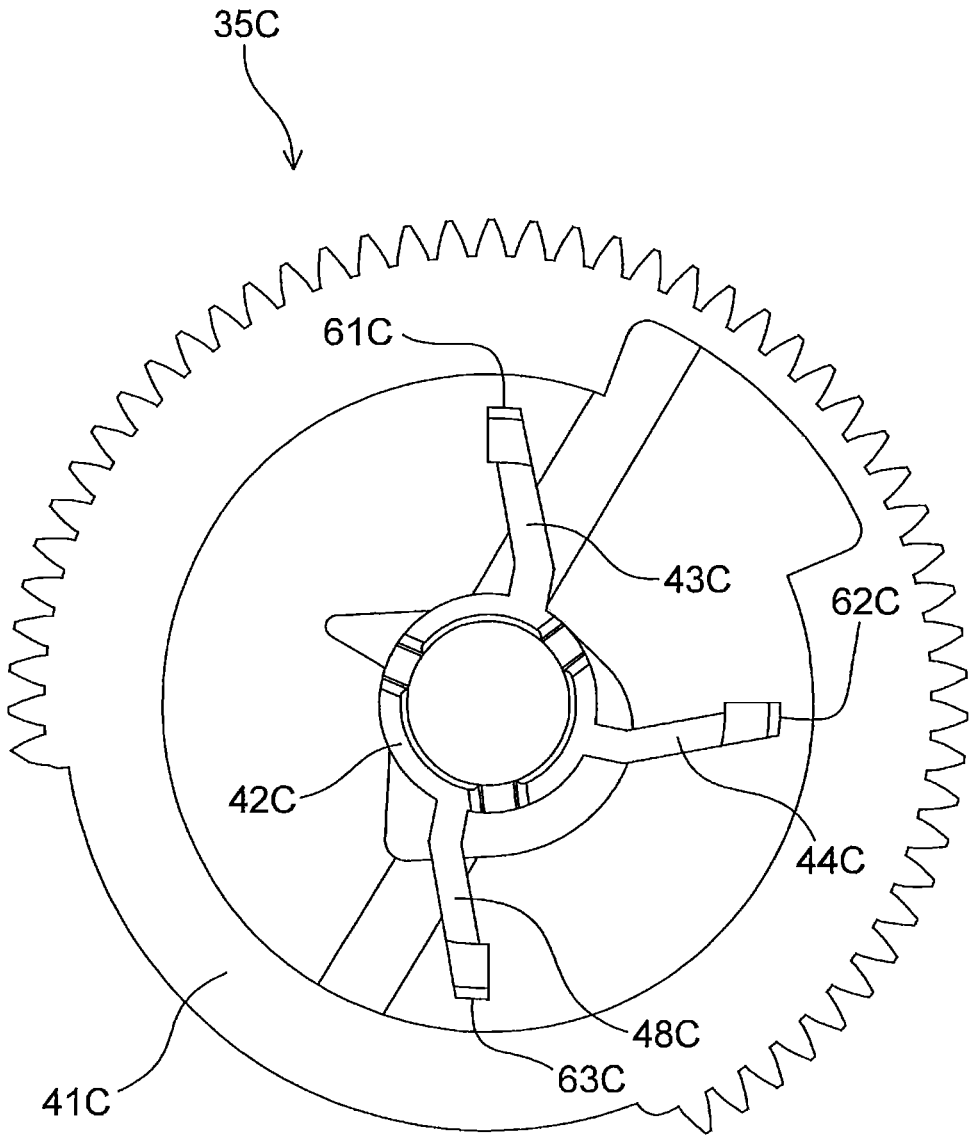
FIG. 17 illustrates yet another detection gear.
Figure 22:
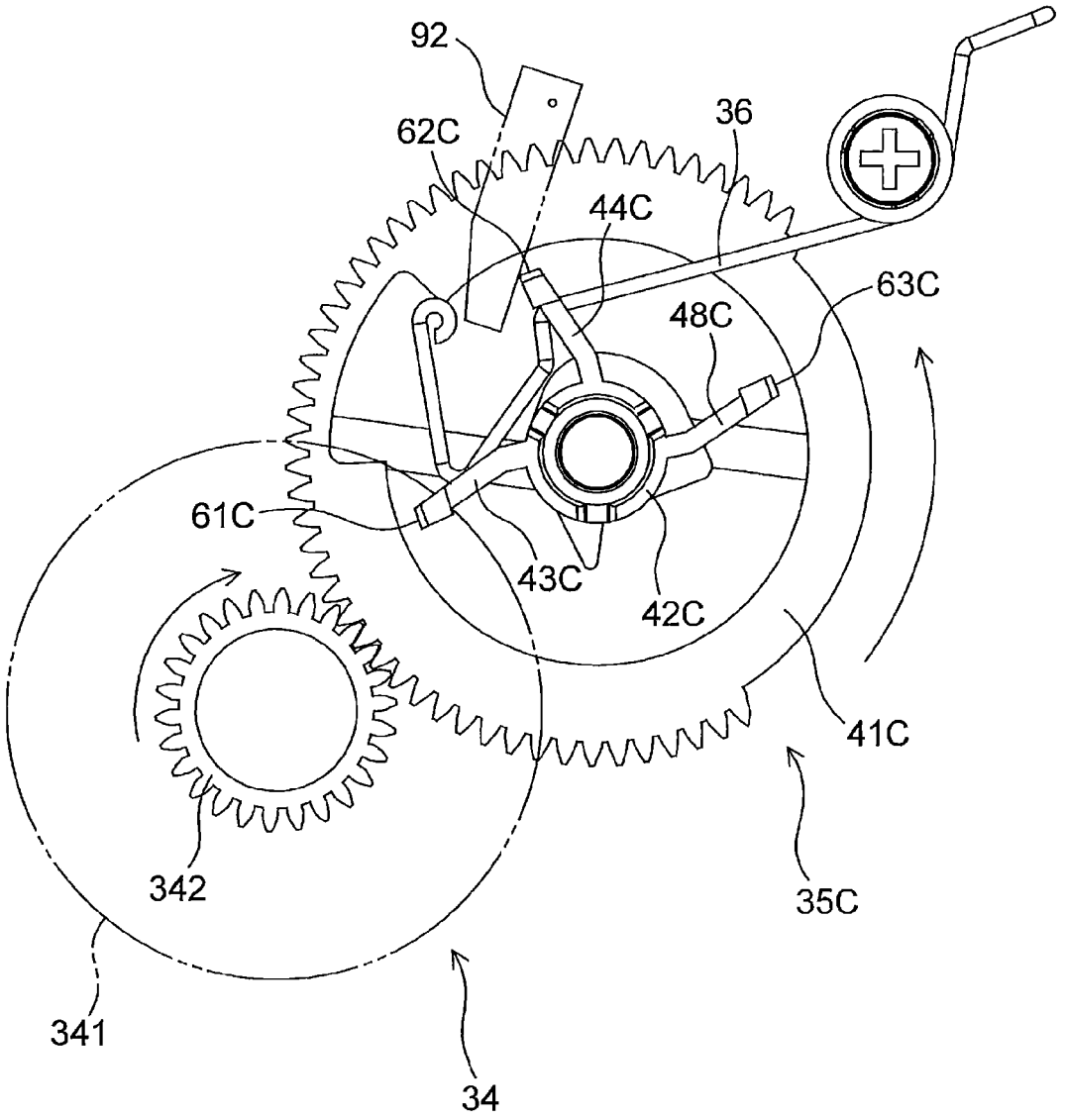
FIG. 22 illustrates a rotational state of yet another detection gear.

In other example, as depicted in FIGS. 17 and 22, a detection gear 35C includes a circular plate 41C, a cylindrical portion 42C, a first protrusion 43C, a second protrusion 44C, and a third protrusion 48C. The circular plate 41C and the cylindrical portion 42C have the same or similar configurations to the circular plate 41 and the cylindrical portion 42, respectively, of the detection gear 35.

The first protrusion 43C, the second protrusion 44C, and the third protrusion 48C protrude outward from an outer circumferential surface of the cylindrical portion 42C in respective directions with respect to a diameter direction of the circular plate 41C. The first protrusion 43C has a first surface 61C at a distal end in the diameter direction of the circular plate 41C. The first surface 61C is contactable with a detection lever of an image forming apparatus. The second protrusion 44C has a second surface 62C at a distal end in the diameter direction of the circular plate 41C. The second surface 62C is contactable with the detection lever subsequent to the first surface 61C. The third protrusion 48C has a third surface 63C at a distal end in the diameter direction of the circular plate 41C. The third surface 63C is contactable with the detection lever subsequent to the second surface 62C. The first protrusion 43C, the second protrusion 44C, and the third protrusion 48C are rotatable with the circular plate 41C and the cylindrical portion 42C. A radial length of the detection gear 35C is greater than a length of the first protrusion 43C in the diameter direction. A radial length of the detection gear 35C is greater than a length of the second protrusion 44C in the diameter direction. A radial length of the detection gear 35C is greater than a length of the third protrusion 48C in the diameter direction.

As depicted in FIGS. 17 and 22, the first surface 61C, the second surface 62C, and the third surface 63C are spaced away from each other in the circumferential direction of the circular plate 41C. The first surface 61C has a length in the circumferential direction of the circular plate 41C that is substantially the same as the length of the first surface 61 of the embodiment in the circumferential direction of the circular plate 41C. A distance in the circumferential direction of the circular plate 41C between the first surface 61C and the second surface 62C is substantially the same as the distance in the circumferential direction of the circular plate 41C between the first surface 61 and the second surface 62. In the detection gear 35C of FIGS. 17 and 22, the first surface 61C and the second surface 62C have substantially the same lengths in the circumferential direction of the circular plate 41C. While the detection gear 35 has two surfaces to be detected, e.g., the first surface 61 and the second surface 62, the detection gear 35C of FIGS. 17 and 22 has three surfaces to be detected, e.g., the first surface 61C, the second surface 62C, and the third surface 63C. The third surface 63C and the second surface 62C have substantially the same lengths in the circumferential direction of the circular plate 41C.

Figure 18:
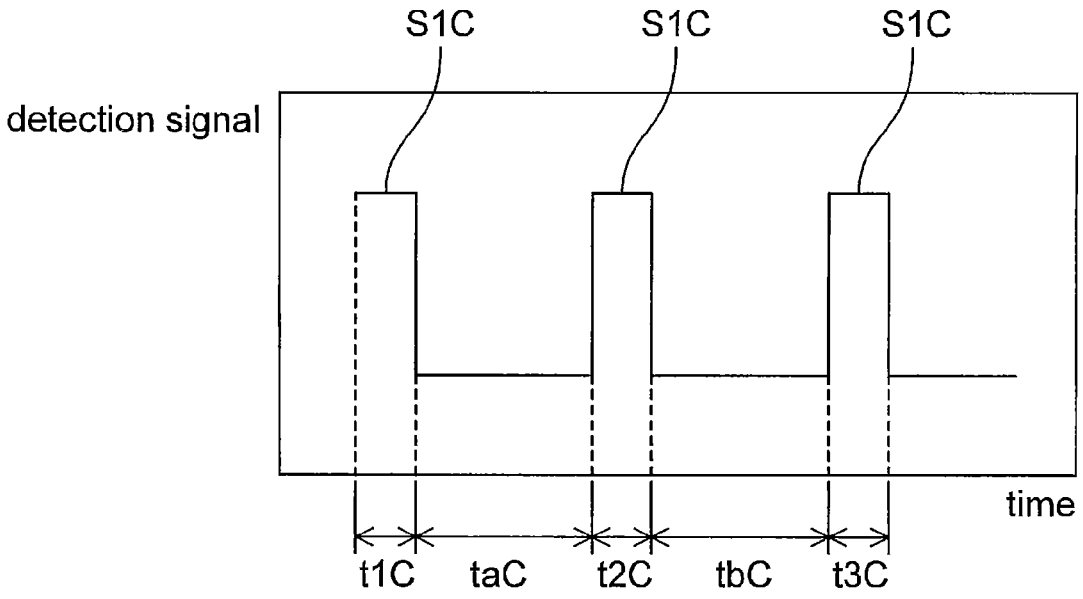
FIG. 18 is a graph showing yet another detection signal pattern.

FIG. 18 is a graph showing a detection signal pattern received by the image forming apparatus in accordance with rotation of the detection gear 35C of FIG. 17. In a case where the detection gear 35 is used, as depicted in FIG. 12, the duration t2 of the second detection signal S2 corresponding to the second surface 62 is longer than the duration t1 of the first detection signal S1 corresponding to the first surface 61. In a case where the detection gear 35C of FIG. 17 is used, as depicted in FIG. 18, a duration t1C of a first detection signal S1C corresponding to the first surface 61C is substantially the same as a duration t2C of a second detection signal S2C corresponding to the second surface 62B. In the case where the detection gear 35C of FIG. 17 is used, as depicted in FIG. 18, a third detection signal S3C corresponding to the third surface 63C is also generated in addition to the first detection signal S1C and the second detection signal S2C. A duration t2C of the second detection signal S2C is substantially the same as a duration t3C of the third detection signal S3C. Therefore, the image forming apparatus can distinguish the detection signal of FIG. 12 and the detection signal of FIG. 18 from each other.

For example, a developer cartridge 1 having a first specification is equipped with the detection gear 35 and another developer cartridge having a fourth specification that is different from the first specification is equipped with the detection gear 35C. In this case, the image forming apparatus can distinguish the developer cartridges from each other based on the received detection signals that are different from each other.

<6. Alternative Embodiments>

While the disclosure has been described in connection with various exemplary structures and illustrative configurations, other variations, changes, and modifications of the structures, configurations, and configurations disclosed above may be applied therein without departing from the spirit and scope of the disclosure.

Hereinafter, a detection gear 35 according to an alternative embodiment will be described. A description will be given mainly for the parts different from the above-described embodiment, and a description will be omitted for the common parts by assigning the same or similar reference numerals thereto.

Figure 19:
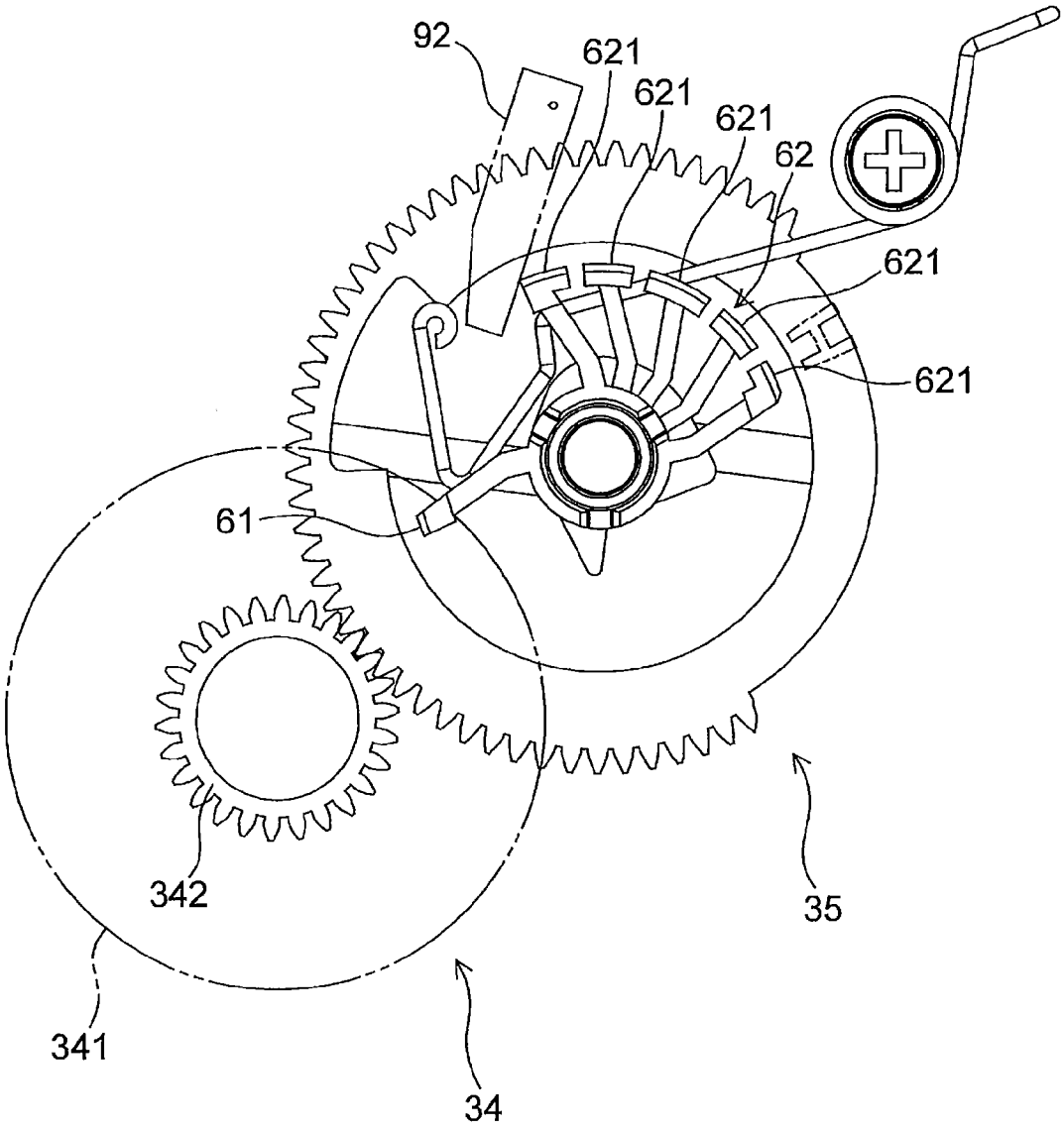
FIG. 19 illustrates a detection gear according to a variation of the embodiment of the present disclosure.

FIG. 19 illustrates the detection gear 35 in the alternative embodiment. In the variation, as depicted in FIG. 19, a second surface 62 includes a plurality of small surfaces 621. The small surfaces 621 are spaced from each other in a circumferential direction of a circular plate 41. While the small surfaces 621 are separate from each other, a gap between each adjacent two of the small surfaces 621 in the circumferential direction of the circular plate 41 is relatively small. Therefore, the detection lever 92 can be displaced smoothly by the small surfaces 621, whereby the image forming apparatus can receive a second detection signal S2 corresponding to an entire length of the second surface 62. In this case, a length of the second surface 62 in the circumferential direction of the circular plate 41 may be a total of lengths of the small surfaces 621 in the circumferential direction of the circular plate 41. In other words, the length of the second surface 62 in the circumferential direction of the circular plate 41 may be a length between a leading end of a foremost small surface 621 of the plurality of small surfaces 621 in the rotational direction and a trailing end of a rearmost small surface 621 of the plurality of small surfaces 621 in the rotational direction. The total of the lengths of the small surfaces 621 in the circumferential direction of the circular plate 41 may be longer than the length of the first surface 61 in the circumferential direction of the circular plate 41.

In the above-described embodiment, each of the gears of the gear unit 30 is capable of engaging with another of the gears of the gear unit 30 through their interlocking teeth. Nevertheless, each of the gears of the gear unit 30 may engage with another of the gears of the gear unit 30 in another manner, for example, through their frictional force. In one example, a detection gear 35 may include a friction member (e.g., a rubber) on a circumference of its first area 51, instead of the teeth. In another example, a detection gear 35 may include a friction member made of material having higher friction coefficient (e.g., rubber) than a circumference of a second area 52 thereof, on a circumference of a first area 51 thereof. In this case, engagement between the small-diameter gear 342 of the agitator gear 34 and the detection gear 35 may be established by contact of the friction member of the detection gear 35 with the small-diameter gear 342.

In the above-described embodiment, the detection gear 35 has two surfaces, e.g., the first surface 61 and the second surface 62, each of which is contactable with the detection lever 92. Nevertheless, in other embodiments, for example, the detection gear 35 may have one or more other surfaces, each of which is contactable with the detection lever 92, in addition to the first surface 61 and the second surface 62.

In the above-described embodiment, the first surface 61 and the second surface 62 of the detection gear 35 are detected using a contact sensor including the detection lever 92. Nevertheless, in other embodiments, for example, the first surface 61 and the second surface 62 of the detection gear 35 may be detected using a non-contact sensor, e.g., an optical sensor or a magnetic sensor.

In the above-described embodiment, the idle gear 33 is disposed between the coupling 31 and the agitator gear 34. Nevertheless, in other embodiments, for example, the coupling 31 and the agitator gear 34 may be engaged with each other directly without the idle gear 33.

In the above-described embodiment, the torsion spring 36 is used as the elastic member. Nevertheless, in other embodiments, for example, a coil spring or resin having elasticity may be used as the elastic member instead of the torsion spring 36.

The above-described embodiments, modification and examples will be summarized as follows.

A developer cartridge comprises a casing configured to accommodate developer therein. The developer cartridge comprises a small-diameter gear. The small-diameter gear is positioned at an exterior surface of the casing. The small-diameter gear is rotatable about a first axis extending in an axial direction. The small-diameter gear includes a first engagement portion along at least a portion of a circumference of the small-diameter gear. The developer cartridge comprises a large-diameter gear. The large-diameter gear is positioned at the exterior surface of the casing. The large-diameter gear is rotatable about the first axis. The large-diameter gear is positioned farther from the exterior surface than the small-diameter gear in the axial direction. The developer cartridge comprises a first gear. The first gear is positioned at the exterior surface of the casing. The first gear is rotatable about a second axis extending in the axial direction. The second axis is different from the first axis. The first gear includes a second engagement portion along at least a portion of a circumference of the first gear. At least a portion of the second engagement portion engages with at least a portion of the first engagement portion. The first gear includes a first end face facing the exterior surface in the axial direction. The first gear includes a second end face opposite to the first end face in the axial direction. The second end face is spaced apart from the large-diameter gear in the axial direction. The second end face being positioned closer to the exterior surface than the large-diameter gear. A portion of the second end face and a portion of the large-diameter gear are aligned along the axial direction. The first gear includes a column. The column is positioned at the second end face, the column extending in the axial direction. An outer diameter of the column is smaller than an outer diameter of the first gear. The column is positioned outside of a rotational circumference defined by rotation of the large-diameter gear. The first gear includes a first protrusion. The first protrusion extends in a radial direction of the first gear. The first protrusion is positioned at a circumference of the column. The first protrusion is spaced apart from the second end face in the axial direction. The first protrusion is farther from the second end face than the large-diameter gear in the axial direction. A rotational circumference of the first protrusion defined by rotation of the first protrusion and a portion of the large-diameter gear are aligned in the axial direction.

With this configuration, if a rotational circumference of the first protrusion defined by rotation of the first protrusion and a portion of the large-diameter gear aligned in the axial direction, the first gear can rotate smoothly because the large-diameter gear does not prevent the first gear and the first protrusion from rotating.

Optionally, the first protrusion extends from the column in the radial direction.

With this configuration, the first protrusion extending from the column the radial direction provides for a gear having a new structure for identifying a specification of a developer cartridge.

Optionally, the first protrusion is positioned at a distal end of the column in the axial direction.

With this configuration, the first protrusion positioned at a distal end of the column in the axial direction provides for a gear having a new structure for identifying a specification of a developer cartridge.

Optionally, the column extends from the second end face in the axial direction.

With this configuration, the column extending from the second end face in the axis direction provides for a gear having a new structure for identifying a specification of a developer cartridge.

Optionally, the first protrusion extends in the radial direction from the distal end of the column in the axial direction.

With this configuration, the first protrusion extending in the radial direction from the distal end of the column in the axial direction provides for a gear having a new structure for identifying a specification of a developer cartridge.

Optionally, a radial length of the first gear is greater than a length of the first protrusion in the radial direction.

With this configuration, the first protrusion provides for a gear having a new structure for identifying a specification of a developer cartridge.

Optionally, the developer cartridge further comprises a gear cover covering at least a portion of the first gear, the gear cover having an opening, in a case where the first gear rotates, at least a portion of the first protrusion is exposed via the opening and at least a portion of the first protrusion is contactable a portion of an image forming apparatus.

With this configuration, if the gear cover covers at least a portion of the first gear cover, the first protrusion can contact the portion of the image forming apparatus via the opening.

Optionally, the developer cartridge further comprises a second protrusion extending in the radial direction, the second protrusion being positioned at the circumference of the column, the second protrusion being apart from the first protrusion in a circumferential direction of the first gear, the second protrusion being apart from the second end face in the axial direction, the second protrusion being farther from the second end face than the large-diameter gear in the axial direction, and a rotational circumference of the second protrusion defined by rotation of the second protrusion and a portion of the large-diameter gear being aligned in the axial direction.

With this configuration, if a rotational circumference of the second protrusion defined by rotation of the second protrusion and a portion of the large-diameter gear aligned in the axial direction, the first gear can rotate smoothly because the large-diameter gear does not prevent the first gear and the second protrusion from rotating.

Optionally, the second protrusion extends from the column in the radial direction.

With this configuration, the second protrusion extending from the column the radial direction provides for a gear having a new structure for identifying a specification of a developer cartridge.

Optionally, the second protrusion is positioned at a distal end of the column in the axial direction.

With this configuration, the second protrusion being positioned at a distal end of the column in the axial direction provides for a gear having a new structure for identifying a specification of a developer cartridge.

Optionally, the column extends from the second end face in the axial direction.

With this configuration, the column extending from the second end face in the axial direction provides for a gear having a new structure for identifying a specification of a developer cartridge.

Optionally, the second protrusion extends in the radial direction from the distal end of the column.

With this configuration, the second protrusion extending in the radial direction from the distal end of the column provides for a gear having a new structure for identifying a specification of a developer cartridge.

Optionally, a radial length of the first gear is greater than a length of the second protrusion in the radial direction.

With this configuration, the second protrusion provides for a gear having a new structure for identifying a specification of a developer cartridge.

Optionally, the developer cartridge further comprises a gear cover covering at least a portion of the first gear, the gear cover having an opening, in a case where the first gear rotates, at least a portion of the second protrusion is exposed via the opening and at least a portion of the second protrusion is contactable with a portion of an image forming apparatus, after at least a portion of the first protrusion is exposed via the opening and at least a portion of the first protrusion is contactable with the portion of the image forming apparatus.

With this configuration, if the gear cover covers at least a portion of the first gear, the second protrusion can contact the portion of the image forming apparatus via the opening after the first protrusion can contact the portion of the image forming apparatus via the opening.

Optionally, the developer cartridge further comprises a third protrusion extending in the radial direction, the third protrusion being positioned at the circumference of the column, the third protrusion being apart from the first protrusion and the second protrusion in the circumferential direction, the third protrusion being apart from the second end face in the axial direction, the third protrusion being farther from the second end face than the large-diameter gear in the axial direction, and a rotational circumference of the third protrusion defined by rotation of the third protrusion and a portion of the large-diameter gear being aligned in the axial direction.

With this configuration, if a rotational circumference of the third protrusion defined by rotation of the third protrusion and a portion of the large-diameter gear aligned in the axial direction, the first gear can rotate smoothly because the large-diameter gear does not prevent the first gear and the third protrusion from rotating.

Optionally, the third protrusion extends from the column in the radial direction.

With this configuration, the third protrusion extending from the column provides for a gear having a new structure for identifying a specification of a developer cartridge.

Optionally, the third protrusion is positioned at a distal end of the column in the radial direction.

With this configuration, the third protrusion being positioned at a distal end of the column in the radial direction provides for a gear having a new structure for identifying a specification of a developer cartridge.

Optionally, the column extends from the second end face in the axial direction.

With this configuration, the column extending from the second end face in the axial direction provides for a gear having a new structure for identifying a specification of a developer cartridge.

Optionally, the third protrusion extends in the radial direction from the distal end of the column.

With this configuration, the third protrusion extending in the radial direction from the distal end of the column provides for a gear having a new structure for identifying a specification of a developer cartridge.

Optionally, a radial length of the first gear is greater than a length of the third protrusion in the radial direction.

With this configuration, the third protrusion provides for a gear having a new structure for identifying a specification of a developer cartridge.

Optionally, the developer cartridge further comprises a gear cover covering at least a portion of the first gear, the gear cover having an opening, in a case where the first gear rotates, at least a portion of the second protrusion is exposed via the opening and at least a portion of the second protrusion is contactable with a portion of an image forming apparatus, after at least a portion of the first protrusion is exposed via the opening and at least a portion of the first protrusion is contactable with the portion of the image forming apparatus, and at least a portion of the third protrusion is exposed via the opening and at least a portion of the third protrusion is contactable with the portion of the image forming apparatus after at least a portion of the second protrusion is exposed via the opening and at least a portion of the second protrusion is contactable with the portion of the image forming apparatus.

With this configuration, if the gear cover covers at least a portion of the first gear cover, the second protrusion can contact the portion of the image forming apparatus via the opening after the first protrusion can contact the portion of the image forming apparatus via the opening, and the third protrusion can contact the portion of the image forming apparatus via the opening after the second protrusion can contact the portion of the image forming apparatus via the opening.

Optionally, the developer cartridge further comprises an agitator extending in the axial direction and rotatable about the first axis, the agitator including a first end portion and a second end portion separated from the first end portion in the axial direction, one of the first end portion and the second end portion penetrates through the casing, the small-diameter gear is mounted to the one of the first end portion and the second end portion, and the small-diameter gear is rotatable with the agitator, and the large-diameter gear is rotatable with the small-diameter gear.

With this configuration, if the developer cartridge comprises the agitator, the small-diameter gear and the large-diameter gear, the first gear can rotate smoothly.

Optionally, the developer cartridge further comprises an input gear rotatable about a third axis extending in the axial direction, and an output gear having a diameter being smaller than a diameter of the input gear, the output gear rotatable with the input gear about the third axis, the output gear positioned farther from the exterior surface of the casing in the axial direction than the input gear, and the output gear engaging with the large-diameter gear.

With this configuration, if the developer cartridge comprises the input gear and the output gear, the first gear can rotate smoothly.

Optionally, the developer cartridge further comprises a coupling rotatable about a fourth axis extending in the axial direction, the coupling including a coupling portion configured to receive driving force, and a coupling gear along a circumference of the coupling, the coupling gear being rotatable with the coupling portion about the fourth axis, the coupling gear engaging with the input gear.

With this configuration, if the developer cartridge comprises the coupling including the coupling portion and the coupling gear, the first gear can rotate smoothly.

Optionally, the developer cartridge further comprises a developing roller rotatable about a fifth axis extending in the axial direction, the developing roller including a roller body, and a roller shaft extending in the fifth axis, the roller shaft rotatable with the roller body, the roller shaft including a third end portion and a fourth end portion separated from the third end portion in the axial direction, and a developing gear mounted to one of the third end portion and the fourth end portion, and the developing gear rotatable with the roller shaft, the developing gear engaging with the coupling gear.

With this configuration, if the developer cartridge comprises the developing roller including the roller body and the roller shaft and comprises the developing gear, the first gear can rotate smoothly.

Optionally, the developer cartridge further comprises a fourth protrusion extending in the axial direction and being positioned at the exterior surface, the fourth protrusion being positioned between the second axis and the fourth axis in a direction connecting to the second axis and the fourth axis, the fourth protrusion being positioned outside a rotational circumference defined by rotation of the first gear, the fourth protrusion being positioned outside a rotational circumference defined by rotation of the small-diameter gear, the fourth protrusion being positioned outside a rotational circumference defined by rotation of the input gear, the fourth protrusion being positioned outside a rotational circumference defined by rotation of the output gear, the fourth protrusion being positioned outside a rotational circumference defined by rotation of the coupling gear, a distal end of the fourth protrusion is spaced apart from an edge of the large-diameter gear that faces the exterior surface in the axial direction.

With this configuration, if the developer cartridge includes the fourth protrusion, the large-diameter gear can rotate smoothly, and the first gear can rotate smoothly.

Optionally, the fourth protrusion extends from the exterior surface.

With this configuration, the developer cartridge includes the fourth protrusion as one piece.

Optionally, the fourth protrusion is positioned outside a rotational circumference defined by rotation of the large-diameter gear.

With this configuration, if the developer cartridge includes the fourth protrusion, the large-diameter gear can rotate smoothly, and the first gear can rotate smoothly.

Optionally, the fourth protrusion includes a surface for receiving a pressing force.

With this configuration, the fourth protrusion can receive the pressing force.

Optionally, the fourth protrusion includes the surface for receiving the pressing force from a drum cartridge toward a photosensitive drum of the drum cartridge, in a case where the developer cartridge is mounted to the drum cartridge.

With this configuration, the fourth protrusion can receive the pressing force from the drum cartridge toward the photosensitive drum of the drum cartridge, in a case where the developer cartridge is mounted to the drum cartridge.

Optionally, the developer cartridge further comprises a fourth protrusion extending in the axial direction, the fourth protrusion being positioned at the exterior surface, the fourth protrusion being positioned between the second axis and the fourth axis in a direction connecting to the second axis and the fourth axis, the fourth protrusion being positioned outside a rotational circumference defined by rotation of the first gear, the fourth protrusion being positioned outside a rotational circumference defined by rotation of the small-diameter gear, the fourth protrusion being positioned outside a rotational circumference defined by rotation of the input gear, the fourth protrusion being positioned outside a rotational circumference defined by rotation of the output gear, the fourth protrusion being positioned outside a rotational circumference defined by rotation of the coupling gear, a distal end of the fourth protrusion is spaced apart from an edge of the large-diameter gear that faces the exterior surface in the axial direction, and the fourth protrusion includes a curved surface curving in a direction from the developing roller toward the fourth protrusion.

With this configuration, if the developer cartridge includes the fourth protrusion including the curved surface, the large-diameter gear can rotate smoothly, and the first gear can rotate smoothly.

Optionally, the second engagement portion is a plurality of gear teeth along a portion of the circumference of the first gear, and at least one of the plurality of gear teeth engages with the first engagement portion.

With this configuration, when the small-diameter gear starts rotating, the first engagement portion engages with at least one of the plurality of gear teeth of the second engagement portion, and the first gear can rotates with the small-diameter gear. Moreover or alternatively, the first gear stops rotating, when the second engagement portion does not engage with the small-diameter gear. At least one of the above-described objects can achieved.

Optionally, the second engagement portion is a plurality of gear teeth along a portion of the circumference of the first gear.

With this configuration, the first gear can rotate with another gear (e.g., small-diameter gear), because the plurality of gear teeth can engage with another gear (e.g., small-diameter gear). Moreover or alternatively, the first gear stops rotating, when the second engagement portion does not engage with another gear (e.g., small-diameter gear). At least one of the above-described objects can achieved.

Optionally, the second engagement portion is a friction portion provided along a portion of the circumference of the first gear.

With this configuration, the first gear can rotate with another gear (e.g., small-diameter gear), because the friction member engages with another gear (e.g., small-diameter gear) by frictional force.

Optionally, the friction portion is a rubber.

With this configuration, the first gear can rotate with another gear (e.g., small-diameter gear), because the rubber engages with another gear (e.g., small-diameter gear) by frictional force.

The details of the developer cartridge 1 are merely example and are not limited to the specific example. In other embodiments, for example, a developer cartridge 1 may have different details from the developer cartridge 1 depicted in the drawings. The components of the above-described embodiments and the components of the alternative embodiments may be used in a single developer cartridge 1 in appropriate combination.

What is claimed is:

1. A developer cartridge comprising:

a casing configured to accommodate developer therein;

a small-diameter gear positioned at an exterior surface of the casing, the small-diameter gear being rotatable about a first axis extending in an axial direction, the small-diameter gear including a first engagement portion along at least a portion of a circumference of the small-diameter gear;

a large-diameter gear positioned at the exterior surface of the casing, the large-diameter gear being rotatable about the first axis, the large-diameter gear positioned farther from the exterior surface than the small-diameter gear in the axial direction; and a first gear positioned at the exterior surface of the casing, the first gear rotatable about a second axis extending in the axial direction, the second axis being different from the first axis, the first gear including:

a second engagement portion along at least a portion of a circumference of the first gear, at least a portion of the second engagement portion engaging with at least a portion of the first engagement portion;

a first end face facing the exterior surface in the axial direction;

a second end face opposite to the first end face in the axial direction, the second end face being spaced apart from the large-diameter gear in the axial direction, the second end face being positioned closer to the exterior surface than the large-diameter gear, and a portion of the second end face and a portion of the large-diameter gear being aligned along the axial direction;

a column positioned at the second end face, the column extending in the axial direction, wherein an outer diameter of the column is smaller than an outer diameter of the first gear, and the column being positioned outside of a rotational circumference defined by rotation of the large-diameter gear; and a first protrusion extending in a radial direction of the first gear, the first protrusion being positioned at a circumference of the column, the first protrusion being spaced apart from the second end face in the axial direction, the first protrusion being farther from the second end face than the large-diameter gear in the axial direction, and a portion of a rotational circumference of the first protrusion defined by rotation of the first protrusion and a portion of the large-diameter gear being aligned in the axial direction.

2. The developer cartridge according to claim 1, wherein the first protrusion extends from the column in the radial direction.

3. The developer cartridge according to claim 1, wherein the first protrusion is positioned at a distal end of the column in the axial direction.

4. The developer cartridge according to claim 1, wherein the column extends from the second end face in the axial direction.

5. The developer cartridge according to claim 4, wherein the first protrusion extends in the radial direction from the distal end of the column in the axial direction.

6. The developer cartridge according to claim 1, wherein a radial length of the first gear is greater than a length of the first protrusion in the radial direction.

7. The developer cartridge according to claim 1, further comprising a gear cover covering at least a portion of the first gear, the gear cover having an opening, wherein, in a case where the first gear rotates, at least a portion of the first protrusion is exposed via the opening and at least a portion of the first protrusion is contactable with a portion of an image forming apparatus.

8. The developer cartridge according to claim 1, further comprising a second protrusion extending in the radial direction, the second protrusion being positioned at the circumference of the column, the second protrusion being apart from the first protrusion in a circumferential direction of the first gear, the second protrusion being apart from the second end face in the axial direction, the second protrusion being farther from the second end face than the large-diameter gear in the axial direction, and a rotational circumference of the second protrusion defined by rotation of the second protrusion and a portion of the large-diameter gear being aligned in the axial direction.

9. The developer cartridge according to claim 8, wherein the second protrusion extends from the column in the radial direction.

10. The developer cartridge according to claim 8, wherein the second protrusion is positioned at a distal end of the column in the axial direction.

11. The developer cartridge according to claim 8, wherein the column extends from the second end face in the axial direction.

12. The developer cartridge according to claim 11, wherein the second protrusion extends in the radial direction from a distal end of the column.

13. The developer cartridge according to claim 8, wherein a radial length of the first gear is greater than a length of the second protrusion in the radial direction.

14. The developer cartridge according to claim 8, further comprising a gear cover covering at least a portion of the first gear, the gear cover having an opening, wherein, in a case where the first gear rotates, at least a portion of the second protrusion is exposed via the opening and is contacted with a portion of an image forming apparatus, after at least a portion of the first protrusion is exposed via the opening and is contacted with the portion of the image forming apparatus.

15. The developer cartridge according to claim 8, further comprising a third protrusion extending in the radial direction, the third protrusion being positioned at the circumference of the column, the third protrusion being apart from the first protrusion and the second protrusion in the circumferential direction, the third protrusion being apart from the second end face in the axial direction, the third protrusion being farther from the second end face than the large-diameter gear in the axial direction, and a portion of a rotational circumference of the third protrusion and a portion of the large-diameter gear being aligned in the axial direction.

16. The developer cartridge according to claim 15, wherein the third protrusion extends from the column in the radial direction.

17. The developer cartridge according to claim 15, wherein the third protrusion is positioned at a distal end of the column in the radial direction.

18. The developer cartridge according to claim 15, wherein the column extends from the second end face in the axial direction.

19. The developer cartridge according to claim 18, wherein the third protrusion extends in the radial direction from a distal end of the column.

20. The developer cartridge according to claim 15, wherein a radial length of the first gear is greater than a length of the third protrusion in the radial direction.

21. The developer cartridge according to claim 15, further comprising a gear cover covering at least a portion of the first gear, the gear cover having an opening, wherein, in a case where the first gear rotates, at least a portion of the second protrusion is exposed via the opening and is contacted with a portion of an image forming apparatus, after at least a portion of the first protrusion is exposed via the opening and is contacted with the portion of the image forming apparatus, and wherein at least a portion of the third protrusion is exposed via the opening and is contacted with the portion of the image forming apparatus after at least a portion of the second protrusion is exposed via the opening and is contacted with the portion of the image forming apparatus.

22. The developer cartridge according to claim 1, further comprising an agitator extending in the axial direction and rotatable about the first axis, the agitator including a first end portion and a second end portion separated from the first end portion in the axial direction, wherein one of the first end portion and the second end portion penetrates through the casing, wherein the small-diameter gear is mounted to the one of the first end portion and the second end portion, and the small-diameter gear is rotatable with the agitator, and wherein the large-diameter gear is rotatable with the small-diameter gear.

23. The developer cartridge according to claim 22, further comprising:

an input gear rotatable about a third axis extending in the axial direction; and an output gear having a diameter being smaller than a diameter of the input gear, the output gear rotatable with the input gear about the third axis, the output gear positioned farther from the exterior surface of the casing in the axial direction than the input gear, and the output gear engaging with the large-diameter gear.

24. The developer cartridge according to claim 23, further comprising a coupling rotatable about a fourth axis extending in the axial direction, the coupling including:

a coupling portion configured to receive driving force; and a coupling gear along a circumference of the coupling, the coupling gear being rotatable with the coupling portion about the fourth axis, the coupling gear engaging with the input gear.

25. The developer cartridge according to claim 24, further comprising:

a developing roller rotatable about a fifth axis extending in the axial direction, the developing roller including: a roller body; and a roller shaft extending in the axial direction, the roller shaft rotatable with the roller body, the roller shaft including a third end portion and a fourth end portion separated from the third end portion in the axial direction, and a developing gear mounted to one of the third end portion and the fourth end portion, and the developing gear rotatable with the roller shaft, the developing gear engaging with the coupling gear.

26. The developer cartridge according to claim 25, further comprising a fourth protrusion extending in the axial direction and being positioned at the exterior surface, the fourth protrusion being positioned between the second axis and the fourth axis in a direction connecting to the second axis and the fourth axis, the fourth protrusion being positioned outside a rotational circumference defined by rotation of the first gear, the fourth protrusion being positioned outside a rotational circumference defined by rotation of the small-diameter gear, the fourth protrusion being positioned outside a rotational circumference defined by rotation of the input gear, the fourth protrusion being positioned outside a rotational circumference defined by rotation of the output gear, the fourth protrusion being positioned outside a rotational circumference defined by rotation of the coupling gear, wherein a distal end of the fourth protrusion is spaced apart from an edge of the large-diameter gear that faces the exterior surface in the axial direction, and wherein the fourth protrusion includes a curved surface curving in a direction from the developing roller toward the fourth protrusion.

27. The developer cartridge according to claim 24, further comprising a fourth protrusion extending in the axial direction, the fourth protrusion being positioned at the exterior surface, the fourth protrusion being positioned between the second axis and the fourth axis in a direction connecting to the second axis and the fourth axis, the fourth protrusion being positioned outside a rotational circumference defined by rotation of the first gear, the fourth protrusion being positioned outside a rotational circumference defined by rotation of the small-diameter gear, the fourth protrusion being positioned outside a rotational circumference defined by rotation of the input gear, the fourth protrusion being positioned outside a rotational circumference defined by rotation of the output gear, the fourth protrusion being positioned outside a rotational circumference defined by rotation of the coupling gear, wherein a distal end of the fourth protrusion is spaced apart from an edge of the large-diameter gear that faces the exterior surface in the axial direction.

28. The developer cartridge according to claim 27, wherein the fourth protrusion extends from the exterior surface.

29. The developer cartridge according to claim 27, wherein the fourth protrusion is positioned outside the rotational circumference defined by rotation of the large-diameter gear.

30. The developer cartridge according to claim 27, wherein the fourth protrusion includes a surface for receiving a pressing force.

31. The developer cartridge according to claim 1, wherein the second engagement portion is a plurality of gear teeth along the portion of the circumference of the first gear, and wherein at least one of the plurality of gear teeth engages with the first engagement portion.

32. The developer cartridge according to claim 1, wherein the second engagement portion is a plurality of gear teeth along the portion of the circumference of the first gear.

* * * * *